US012808273B2

(12) United States Patent
Hergarden

(10) Patent No.: US 12,808,273 B2
(45) Date of Patent: Nov. 24, 2026

(54) DRILL-THROUGH TUBING HEAD ASSEMBLY

(71) Applicant: FMC Technologies, Inc., Houston, TX (US)

(72) Inventor: Thomas Lars Hergarden, Spring, TX (US)

( * ) Notice: Subject to any disclaimer, the term of this patent is extended or adjusted under 35 U.S.C. 154(b) by 668 days.

(21) Appl. No.: 17/963,896

(22) Filed: Oct. 11, 2022

(65) Prior Publication Data

US 2024/0117700 A1 Apr. 11, 2024

(51) Int. Cl.
*E21B 33/03* (2006.01)
*E21B 33/04* (2006.01)

(52) U.S. Cl.
CPC ..... *E21B 33/04* (2013.01)

(58) Field of Classification Search
CPC ..... E21B 33/04; E21B 33/047; E21B 33/03; E21B 33/0422
See application file for complete search history.

(56) References Cited

U.S. PATENT DOCUMENTS 3,087,547 A * 4/1963 Raulins ..... E21B 33/04 166/89.1
3,193,308 A * 7/1965 Todd ..... E21B 33/04 285/123.6
3,268,241 A * 8/1966 Word, Jr. ..... E21B 33/043 285/317
3,353,595 A * 11/1967 Gruller ..... E21B 33/047 166/347
4,595,063 A * 6/1986 Jennings ..... E21B 33/043 285/123.4
4,900,041 A 2/1990 Hopkins et al.
5,174,376 A 12/1992 Singeetham
6,942,028 B2 9/2005 Hosie
8,434,560 B2 * 5/2013 Baskett ..... E21B 33/043 166/88.4
10,844,687 B2 * 11/2020 Rodela ..... E21B 33/128
2003/0019632 A1 * 1/2003 Humphrey ..... E21B 33/047 166/368
2005/0284640 A1 * 12/2005 Borak ..... E21B 33/04 166/75.13
2007/0007012 A1 1/2007 Bartlett et al.
2008/0006412 A1 * 1/2008 Ford ..... E21B 33/043 166/368

(Continued)

FOREIGN PATENT DOCUMENTS

CA 2 734 186 C 2/2010
WO WO 2022/022860 A1 2/2022

*Primary Examiner* — Kipp C Wallace
(74) *Attorney, Agent, or Firm* — Henry C. Query, Jr.

(57) ABSTRACT

A tubing head assembly for housing a tubing hanger in a well completion system is disclosed. The well completion system includes a wellhead positioned at the upper end of a well bore and a christmas tree positioned above the wellhead. The tubing head system includes a tubing head connectable to the top of the wellhead and having an axially extending central bore, and a tubular adapter sleeve configured to be secured and sealed in the central bore and having an axially extending sleeve bore which is configured to receive the tubing hanger. In use of the tubing head assembly, the tubing hanger is positioned in the sleeve bore and the adapter sleeve is positioned in the central bore to thereby position the tubing hanger in the tubing head.

15 Claims, 13 Drawing Sheets

(56) References Cited

U.S. PATENT DOCUMENTS

| | | | | |
|---|---|---|---|---|
| 2008/0017383 | A1 | 1/2008 | Minassian et al. | |
| 2011/0088893 | A1* | 4/2011 | Gette | E21B 33/04 166/195 |
| 2014/0182860 | A1 | 7/2014 | Harsono et al. | |
| 2015/0159458 | A1 | 6/2015 | Tan et al. | |
| 2017/0183932 | A1* | 6/2017 | Cotton | E21B 33/03 |
| 2022/0042391 | A1 | 2/2022 | Murphy | |
| 2023/0076356 | A1* | 3/2023 | Bourgeois | E21B 33/0422 |

* cited by examiner

DRILL-THROUGH TUBING HEAD ASSEMBLY

The present disclosure is directed to a tubing head assembly for housing a tubing hanger in a well completion system. More particularly, the disclosure is directed to a tubing head assembly which in a first configuration comprises a bore having a diameter approximately the same as or larger than the diameter of the wellhead bore to enable drilling of the well bore through the tubing head assembly prior to installation of the tubing hanger, and in a second configuration comprises a bore which is sufficiently small to engage with the tubing hanger.

BACKGROUND OF THE DISCLOSURE

Prior art vertical-type well completion systems typically include a wellhead positioned at the upper end of a well bore, a christmas tree positioned above the wellhead and a tubing hanger positioned in the wellhead. During completion of such systems, a blowout preventer (BOP) is connected to the top of the wellhead, the well bore is drilled through the BOP and the wellhead, and the tubing hanger is lowered through the BOP and landed in the wellhead, after which the BOP is removed and the christmas tree is installed on the wellhead.

In certain applications it is not desirable or possible to position the tubing hanger in the wellhead. In these instances, a tubing head (which is sometimes referred to as a tubing spool) is mounted to the top of the wellhead and the tubing hanger is positioned in the tubing spool. Traditional tubing heads normally include means located in the tubing head bore for orienting the tubing hanger to the tubing head, a landing shoulder on which the tubing hanger is supported, and a number of exposed sealing profiles for the tubing hanger, which are commonly located on or adjacent reduced diameter steps in the tubing head bore.

These features restrict the tubing head bore and normally make drilling of the well bore through the tubing head impractical. As a result, the well bore must typically be drilled through the BOP and the wellhead, the well must be secured, the BOP must be temporarily removed so that the tubing head can be installed, and then the BOP must be re-installed before the tubing hanger can be installed in the tubing head. These procedures are time consuming and costly.

In some well completion systems the well bore can be drilled through the tubing head. However, these systems require a reduced bore wellhead system, which can create limitations to drilling.

SUMMARY OF THE DISCLOSURE

In accordance with the present disclosure, these and other disadvantages are addressed by providing a tubing head assembly for housing a tubing hanger in a well completion system. The well completion system includes a wellhead positioned at the upper end of a well bore and a christmas tree positioned above the wellhead, and the tubing head system comprises a tubing head connectable to the top of the wellhead, the tubing head comprising an axially extending central bore; and a tubular adapter sleeve configured to be secured and sealed in the central bore, the adapter sleeve including an axially extending sleeve bore which is configured to receive the tubing hanger. In use of the tubing head assembly, the tubing hanger is positioned in the sleeve bore and the adapter sleeve is positioned in the central bore to thereby position the tubing hanger in the tubing head.

In accordance with one embodiment, the adapter sleeve may comprise an annular tubing hanger landing shoulder, and in use of the tubing head assembly the tubing hanger is supported on the tubing hanger landing shoulder.

In accordance with another embodiment, the wellhead comprises a wellhead bore having a first nominal diameter and the central bore may have a second nominal diameter which is approximately the same as the first nominal diameter.

In accordance with yet another embodiment, the tubing head may comprise a first locking profile located in the central bore and the adapter sleeve may comprise a first locking element which is engageable with the first locking profile to thereby secure the adapter sleeve to the tubing head.

In accordance with a further embodiment, the tubing head may comprise an annular first sealing profile located in the central bore and the adapter sleeve may comprise a first sealing element which is configured to sealingly engage the first sealing profile to thereby seal an annulus between the central bore and the adapter sleeve. In one exemplary embodiment, the first sealing profile may be approximately flush with or recessed in the central bore. In another exemplary embodiment, the adapter sleeve may comprise an annular second sealing profile and the first sealing element may be configured to sealingly engage both the first and second sealing profiles to thereby seal the annulus between the central bore and the adapter sleeve.

In accordance with one embodiment, the adapter sleeve may comprise a second locking profile located in the sleeve bore which is operatively engageable by a second locking element on the tubing hanger to thereby secure the tubing hanger to the adapter sleeve, and the sleeve bore may comprise an annular third sealing profile configured to be sealingly engaged by a second sealing element on the tubing hanger to thereby seal an annulus between the tubing hanger and the adapter sleeve.

In accordance with another embodiment, the tubing head assembly may comprise means for orienting the adapter sleeve to the tubing head. The means for orienting the adapter sleeve to the tubing head may comprise, for example, a key supported on the adapter sleeve and a corresponding slot formed in the central bore. In this example, the slot is positioned so as to receive the key when the adapter sleeve is in a predetermined orientation relative to the tubing head. In one exemplary embodiment, the tubing head assembly may also comprise means for orienting the tubing hanger to the adapter sleeve.

In accordance with another embodiment, the adapter sleeve may comprise a first bypass bore which extends from a part of the sleeve bore below the third sealing profile to a part of the central bore below the first sealing profile. In a further embodiment, the tubing head may comprise a second bypass bore which extends from the part of central bore below the first sealing profile to a part of the central bore above the first sealing profile. Additionally, the tubing head may comprise a bypass valve and the second bypass bore may comprise a first branch which extends from the part of the central bore below the first sealing profile to the bypass valve and a second branch which extends from the bypass valve to the part of the central bore above the first sealing profile. In this example, the bypass valve is operable to open or close the first branch.

In accordance with yet another embodiment, the adapter sleeve may include a downward facing load shoulder which is configured to engage a load component located in the wellhead, and the adapter sleeve may be configured to transfer the weight of the tubing hanger from the tubing hanger landing shoulder through the load shoulder to the load component. In one exemplary embodiment, the adapter sleeve may comprise a load nut on which the load shoulder is located, and the load nut may be axially movable relative to the first locking element to thereby adjust an axial distance between the first locking element and the load shoulder.

In accordance with a further embodiment of the disclosure, the central bore may comprise an annular groove and the adapter sleeve may comprises a tubular body portion on which the tubing hanger landing shoulder is located, the body portion comprising a radially outwardly directed actuating surface and a downwardly directed load shoulder located above the actuating surface; a trigger sleeve positioned at least partially below the body portion, the trigger sleeve being slidably supported relative to the body portion; and a load ring radially moveably supported on the trigger sleeve, the load ring being configured to engage the actuation surface and the load shoulder. In this embodiment, the body portion is movable relative to the trigger sleeve from a first position in which the actuating surface is located above the load ring to a second position in which at least a part of the actuating surface is located radially adjacent the load ring. Further, the actuating surface may be configured such that, when the body portion is moved axially downwardly relative to the trigger sleeve from its first position to its second position, the actuating surface will force the load ring radially outwardly into engagement with the groove. In this example, in the second position of the body portion, the load shoulder engages the load ring such that the weight of the tubing hanger is transmitted from the tubing hanger landing shoulder through the load shoulder and the load ring to the tubing head.

In accordance with one aspect, the trigger sleeve may comprise a downwardly directed trigger shoulder configured to engage a trigger component located in the wellhead to thereby maintain the load ring in a fixed axial position relative to the tubing head. In accordance with another aspect, the adapter sleeve may comprise an energizing mandrel which is movable to force the first sealing element into engagement with the first sealing profile or with both the first and second sealing profiles, and wherein the first locking element is supported on the energizing mandrel. In certain embodiments, the energizing mandrel may comprise an upper mandrel part which is axially movably connected to a lower mandrel part. In this example, the first locking element may be supported on the upper mandrel part and the upper mandrel part may be axially movable relative to the lower mandrel part to thereby adjust an axial distance between the first locking profile and the load shoulder on the adapter sleeve.

In accordance with yet another embodiment, the second locking profile may be located on the energizing mandrel.

The present disclosure is also directed to a method of installing a tubing hanger in a well completion system comprising a wellhead positioned at an upper end of a well bore. In accordance with one embodiment, the method comprises the steps of providing a tubing head assembly which includes a tubing head having an axially extending central bore and a tubular adapter sleeve configured to be secured and sealed in the central bore, the adapter sleeve including an axially extending sleeve bore configured to receive the tubing hanger; mounting the tubing head to the wellhead; positioning the adapter sleeve in the central bore; securing and sealing the adapter sleeve to the tubing head; positioning the tubing hanger in the sleeve bore; and securing and sealing the tubing hanger to the adapter sleeve.

In accordance with a further embodiment, the method may comprise the step of orienting the adapter sleeve to the central bore.

In accordance with yet another embodiment, the sleeve bore may comprise an annular landing shoulder and the step of positioning the tubing hanger in the sleeve bore may comprise positioning the tubing hanger on the landing shoulder. In accordance with an exemplary embodiment, the step of positioning the adapter sleeve in the central bore may comprise supporting the adapter sleeve on a load component located in the wellhead. In this example, the weight of the tubing hanger is transmitted through the adapter sleeve and the load component to the wellhead.

In accordance with another exemplary embodiment, the step of positioning the adapter sleeve in the central bore may comprise supporting the adapter sleeve on a load ring which is engaged in an annular groove located in the central bore. In this example, the weight of the tubing hanger is transmitted through the adapter sleeve and the load ring to the tubing head.

In accordance with one embodiment, the method further comprises the step of, prior to the step of supporting the adapter sleeve on the load ring, forcing the load ring into engagement with the groove. In this example, the step of forcing the load ring into engagement with the groove is performed by the adapter sleeve during the step of positioning the adapter sleeve in the central bore. In accordance with one aspect, the adapter sleeve may comprise a tubular body portion and a trigger sleeve which is positioned at least partially below the body portion, the load ring may be supported on the trigger sleeve, and the step of forcing the load ring into engagement with the groove may be performed by the body portion by moving the body portion axially toward the trigger sleeve.

In accordance with yet another embodiment, the method may comprise the step of, prior to the step of positioning the adapter sleeve in the central bore, drilling the well bore through the tubing head and the wellhead.

The present disclosure is also directed to a tubing head assembly for housing a tubing hanger in a well completion system comprising a wellhead positioned at the upper end of a well bore and a christmas tree positioned above the wellhead. In accordance with one embodiment, the tubing head system comprises a tubing head connectable to the top of the wellhead, the tubing head comprising an axially extending central bore, an annular locking profile formed in the central bore, and an annular sealing profile located in the central bore. The locking profile may be engageable by a locking element on the tubing hanger to thereby lock the tubing hanger to the tubing head, and the sealing profile may be sealingly engageable by a sealing element on the tubing hanger to thereby seal an annulus between the central bore and the tubing hanger. In use of the tubing head assembly, the tubing hanger is positioned in the central bore to thereby position the tubing hanger in the tubing head.

In accordance with one embodiment of the disclosure, the sealing profile may be approximately flush with the central bore. In one aspect, the sealing profile may be recessed in the central bore.

In accordance with a further embodiment, the wellhead comprises a wellhead bore having a first nominal diameter and the central bore has a second nominal diameter which may be approximately the same as the first nominal diameter.

In accordance with yet another embodiment, the tubing head assembly may include means for orienting the tubing hanger to the tubing head.

In accordance with another embodiment, the tubing hanger may be supported on a load component located in the wellhead.

In accordance with yet another embodiment, the tubing head may comprise a bypass bore which extends from a part of central bore below the sealing profile to a part of the central bore above the sealing profile. In one aspect, the tubing head may also comprise a bypass valve and the bypass bore may comprise a first branch which extends from the part of the central bore below the first sealing profile to the bypass valve and a second branch which extends from the bypass valve to the part of the central bore above the sealing profile. In this example, the bypass valve is operable to open or close the first branch.

In accordance with another embodiment of the disclosure, the central bore comprises an annular groove and the tubing hanger comprises a tubular body portion having a radially outwardly directed actuating surface and a downwardly directed load shoulder located above the actuating surface; a trigger sleeve slidably supported relative to the body portion; and a load ring radially moveably supported on the trigger sleeve, the load ring being configured to engage the actuation surface and the load shoulder. In this embodiment, the body portion is movable relative to the trigger sleeve from a first position in which the actuating surface is located above the load ring to a second position in which at least a part of the actuating surface is located radially adjacent the load ring. The actuating surface may be configured such that, when the body portion is moved axially downwardly relative to the trigger sleeve from its first position to its second position, the actuating surface will force the load ring radially outwardly into engagement with the groove. Also, in the second position of the body portion, the load shoulder engages the load ring such that the weight of the tubing hanger is transmitted through the load shoulder and the load ring to the tubing head. In accordance with one aspect, the trigger sleeve may comprise a downwardly directed trigger shoulder configured to engage a trigger component located in the wellhead to thereby maintain the load ring in a fixed axial position relative to the tubing head.

Thus, the tubing head assembly of the present disclosure enables drilling and completion of the well bore through the tubing head without any of the limitations discussed above. In certain embodiments this is accomplished by designing the tubing head such that the central bore does not include any features which could limit full bore access to the wellhead bore, such as load shoulders, trigger shoulders or exposed seal bores. To the contrary, in some embodiments the first sealing profile is approximately flush with or recessed in the central bore. In addition, the first locking profile and the orientation slot are recessed in the central bore. Moreover, in certain embodiments the nominal diameter of the central bore is approximately the same as that of the wellhead bore. As a result, the tubing head is capable of providing full bore access to the wellhead bore, which will enable drilling and completion of the well bore through the tubing head.

These and other objects and advantages of the present disclosure will be made apparent from the following detailed description, with reference to the accompanying drawings. In the drawings, the same reference numbers may be used to denote similar components in the various embodiments.

DETAILED DESCRIPTION OF THE DISCLOSURE

Figure 1:
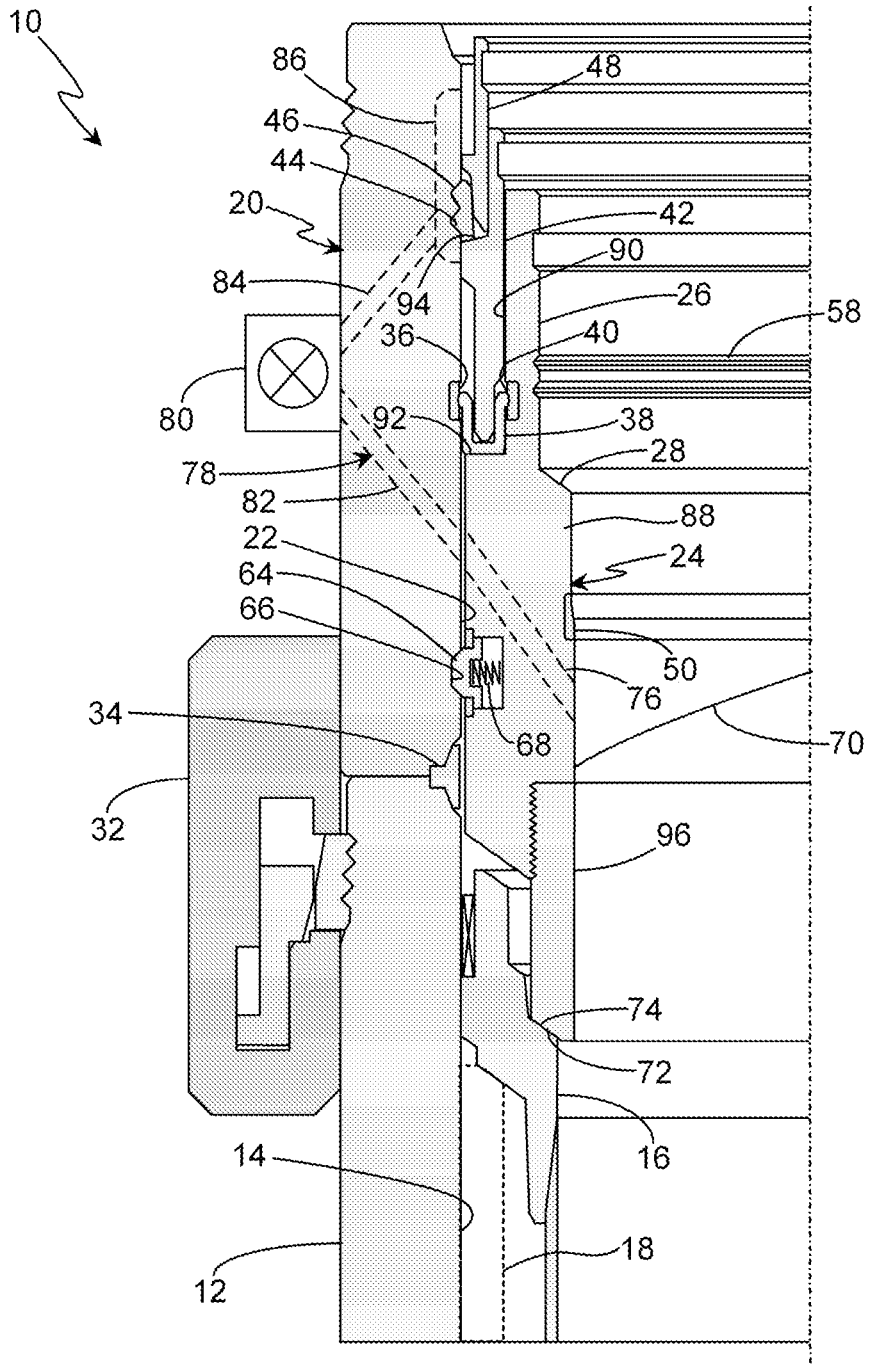
FIG. 1 is a cross sectional view of an illustrative embodiment of a tubing head assembly of the present disclosure shown mounted to a wellhead.

The present disclosure is directed to a tubing head assembly for a well completion system. The tubing head assembly is particularly suitable for use in vertical-style well completion systems, which typically include a wellhead which is positioned at the upper end of a well bore, a christmas tree which is mounted to the top of the wellhead and a tubing hanger which is landed in the wellhead. The tubing head assembly is especially suitable for use in certain well completion systems in which it is not desirable or possible to position the tubing hanger in the wellhead. In these and other applications, the tubing head assembly provides a means for housing the tubing hanger above the wellhead and below the christmas tree. In certain configurations, the tubing head assembly provides full-bore access to the wellhead, which enables drilling and completion of the well bore through the tubing hanger assembly.

In accordance with one embodiment of the disclosure, the tubing head assembly includes a tubing head having an axially extending central bore and a tubular adapter sleeve configured to be secured and sealed in the central bore. The adapter sleeve includes an axially extending sleeve bore which is configured to receive the tubing hanger. In use of the tubing head assembly, the tubing head is connected to the top of the wellhead, the tubing hanger is secured and sealed to adapter sleeve, and the adapter sleeve is secured and sealed to the central bore. This embodiment of the tubing head assembly eliminates the need for the central bore to include a tubing hanger landing shoulder or other features which could otherwise restrict the size of the central bore and inhibit the ability to drill and complete the well through the tubing head.

A first embodiment of the tubing head assembly of the present disclosure is shown in FIGS. 1-5. The tubing head assembly of this embodiment, which is indicated generally by reference number 10, is shown mounted on an exemplary wellhead 12 having an axially extending wellhead bore 14 within which a casing hanger 16 is installed. The casing hanger 16 may be supported, e.g., on a landing shoulder 18 (shown in phantom) which is formed on or secured to the wellhead bore 14, or on one or more intermediate casing hangers (not shown) which in turn are supported on the landing shoulder.

Referring to FIG. 1, the tubing head assembly 10 of this embodiment of the disclosure includes a tubing head 20 having a generally cylindrical central bore 22 and a tubular adapter sleeve 24 which is configured to be secured and sealed to the central bore. The adapter sleeve 24 includes an axially extending sleeve bore 26 which is configured to receive a tubing hanger 30 (see FIG. 5). In certain embodiments the adapter sleeve 24 may also include an annular landing shoulder 28 on which the tubing hanger 30 is supported. The landing shoulder 28 may be located, e.g., in the sleeve bore. In this embodiment, the weight of the tubing hanger 30 and its associated tubing string is transferred through the adapter sleeve 24 to either the wellhead 12 or the tubing head 20, as will be described more fully below.

In an alternative embodiment (not shown), the adapter sleeve 24 may be configured such that the tubing hanger 30 extends through the sleeve bore 26 and is supported on a load component located in the wellhead 12, such as the casing hanger 16, an intermediate casing hanger (not shown), or the landing shoulder 18.

As shown in FIG. 1, the central bore 22 may in certain embodiments comprise a nominal diameter approximately the same as the nominal diameter of the wellhead bore 14. In this regard, the phrase "approximately the same" may be taken to mean within 5%. Accordingly, in this embodiment the central bore 22 may have a nominal diameter within 5% of the nominal diameter of the wellhead bore 14. As a result, the tubing head 20 is capable of providing full bore access to the wellhead bore 14, which will facilitate drilling of the well bore through the tubing head.

As an example, in this embodiment the tubing head 20 can be installed with or shortly after the wellhead 12 is installed, a BOP can be installed on the tubing head, and the well bore can be drilled through the tubing head and the wellhead, after which the adapter sleeve 24 and the tubing hanger 30 can be installed in the tubing head without having to remove and retrieve the BOP. By comparison, in typical prior art well completion systems requiring the use of a tubing head, the BOP is lowered from the surface vessel and installed on the wellhead, the well bore is drilled through the wellhead, the well is suspended (i.e., made secure by installing one or more temporary barriers in the well bore), the BOP is removed from the wellhead, the tubing head is lowered from the surface vessel and installed on the wellhead, the BOP is installed on the tubing head, the temporary barriers are removed, and then the tubing hanger is installed in the tubing head. Thus, the tubing head system 10 of the present embodiment eliminates the need for several time consuming running and retrieval operations.

The tubing head assembly 10 may be mounted to the wellhead 12 using any suitable means. For example, a conventional hydraulic connector 32 may be attached to the lower end of the tubing head 20 and then connected to the top of the wellhead 12 in a known manner to thereby secure the tubing head to the wellhead. Also, the tubing head 20 may be sealed to the wellhead 12 using a conventional sealing element, such as a VX gasket 34.

In certain embodiments of the disclosure, the tubing head assembly 10 may also include means for sealing the adapter sleeve 24 to the tubing head 20. Referring still to FIG. 1, for example, the central bore 22 may be provided with an annular first sealing profile 36 and the adapter sleeve 24 may be provided with an annular first sealing element 38 which is configured to sealingly engage the first sealing profile to thereby seal the annulus between the central bore and the adapter sleeve from pressure in the well bore. Although the first sealing profile 36 is illustrated as being a distinct component, it may instead comprise a defined annular surface of the central bore 22 or a surface treatment or cladding which is formed on a specific annular area of the sleeve bore 26. Additionally, the first sealing profile 36 may be approximately flush with the central bore so as not to restrict the central bore. In this regard, the phrase "approximately flush with" may be taken to mean that the first sealing profile 36 comprises an inner diameter within 5% of the nominal diameter of the central bore 22. In some embodiments the first sealing profile 36 may be recessed in the central bore 22 (i.e., comprise an inner diameter which is larger than the nominal diameter of the central bore) in order to protect the first sealing profile from damage during drilling of the well bore or installation of the adapter sleeve 24.

The first sealing element 38 may comprise any appropriate seal which is suitable for sealing the annulus between the central bore 22 and the adapter sleeve 24 against anticipated pressures in the well bore. In the embodiment shown in FIG. 1, for instance, the first sealing element 38 is shown to comprise a generally U-shaped cross section having radially outer and inner arms, and the radially outer arm is configured to sealingly engage the first sealing profile 36. In an alternative embodiment not shown in the drawings, the first sealing element 38 may be connected to or formed integrally with the adapter sleeve 24. In this example, the first sealing element 38 may comprise a radially outwardly directed arm or other sealing portion which is configured to sealingly engage the first sealing profile 36.

In the illustrative embodiment of the disclosure shown in FIG. 1, the adapter sleeve 24 may comprise an annular second sealing profile 40 which is located on an outer diameter surface portion of the adapter sleeve. In this embodiment, the first sealing element 38 may be configured to sealingly engage both the first and second sealing profiles 36, 40 to thereby seal the annulus between the central bore 22 and the adapter sleeve 24 from pressures in the well bore. As shown in FIG. 1, for example, the first sealing element 38 may comprise a generally U-shaped cross section having radially outer and inner arms which are configured to sealingly engage the first and second sealing profiles 36, 40, respectively. As with the first sealing profile 36, the second sealing profile 40 may comprise a defined area on an outer diameter surface portion of the adapter sleeve 24, a surface treatment or cladding which is formed on this defined area, or a separate component which is mounted in the outer diameter surface portion.

The first sealing element 38 and the first and second sealing profiles 36, 40 may in some embodiments be made of suitable metal materials in order to provide a metal-to-metal seal between the central bore 22 and the adapter sleeve 24. Metal-to-metal seals are generally better able to withstanding the high pressures and temperatures typically encountered in certain subsea flow completion applications than non-metal seals.

In accordance with some embodiments, the tubing head system 10 may include means for forcing the first sealing element 38 into engagement with the first and second sealing profiles 36, 40 (or with just the first sealing profile in embodiments such as described above in which the first sealing element is connected to or formed integrally with the adapter sleeve 24). As shown in FIG. 1, for example, the tubing head system 10 may include an energizing mandrel 42 which is slidably supported on the adapter sleeve 24 and movable into operative engagement with the first sealing element 38 to thereby force the first sealing element into engagement with the first and second sealing profiles 36, 40

(or into engagement with just the first sealing profile). In embodiments in which the first sealing element 38 comprise a generally U-shaped cross section having radially outer and inner arms, the energizing mandrel 42 may comprise an axially depending nose portion which is configured to extend between the arms and force the arms into sealing engagement with their respective sealing profiles 36, 40 when the energizing mandrel is moved into operative engagement with the first sealing element. The energizing mandrel 42 may be moved into operative engagement with the first sealing element 38 by any appropriate means, such as a tubing hanger running tool or other installation tool (not shown) which is used to install the adapter sleeve 24 in the tubing head 20. The design and operation of such a tubing hanger running tool or installation tool are within the capabilities of persons skilled in the art and will therefore not be described further herein.

In certain embodiments the tubing head assembly 10 may also include means for securing the adapter sleeve 24 to the tubing head 20. Referring still to FIG. 1, for example, the tubing head 20 may comprise a first locking profile 44 located in the central bore 22 and the adapter sleeve 24 may include a first locking element 46 which is operatively engageable with the first locking profile to thereby secure the adapter sleeve 24 to the tubing head 20. The first locking element 46 may comprise, e.g., a radially expandable lock ring or a plurality of locking dogs. In this example embodiment, the first locking element 46 is expanded radially outwardly into operative engagement with the first locking profile 44 by means of a first locking mandrel 48 slidably supported on the adapter sleeve 24. The first locking mandrel 48 may be moved into operative engagement with the first locking element 46 by any suitable means, such as the aforementioned tubing hanger running tool or installation tool.

Figure 5:
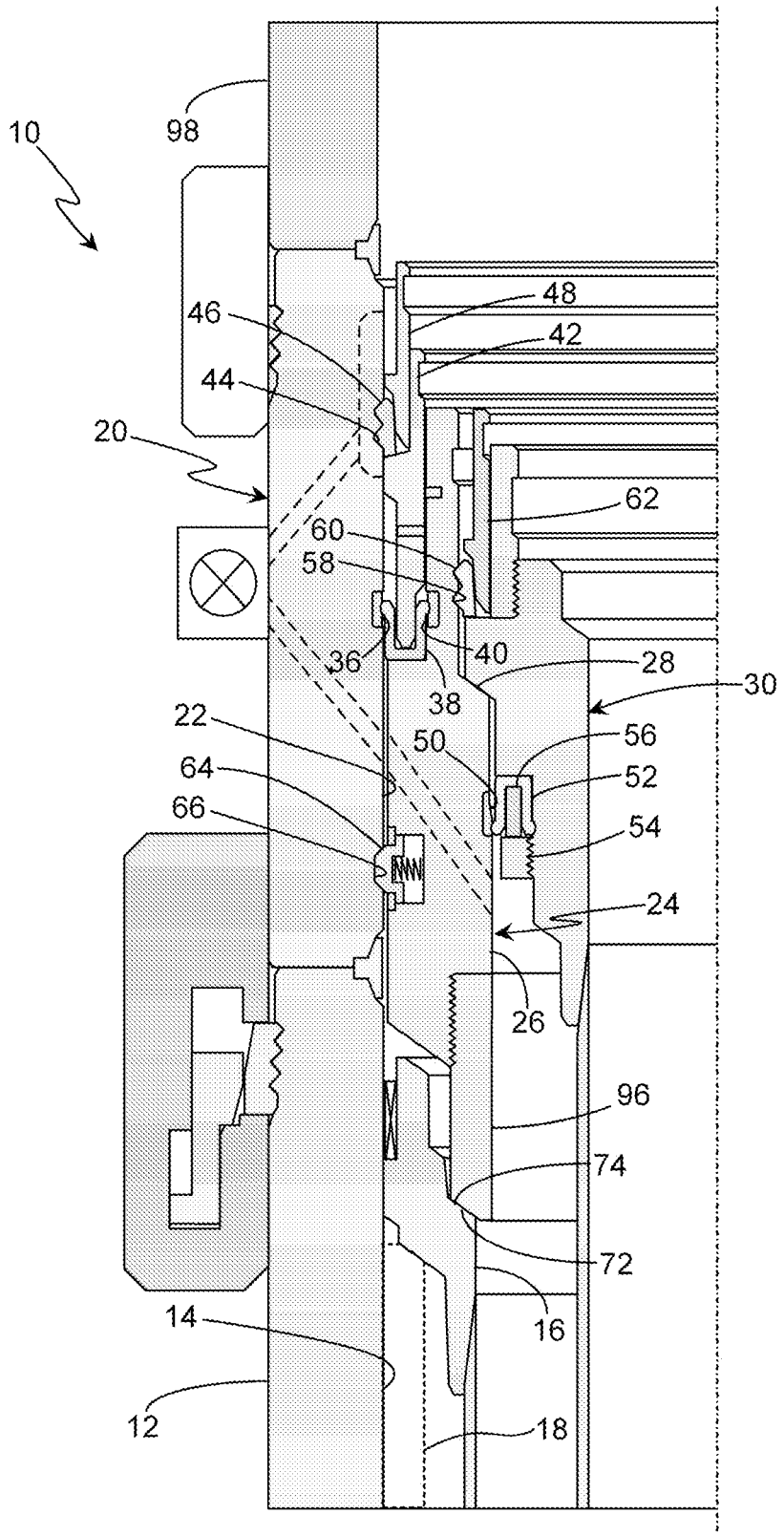

Referring also to FIG. 5, which shows an exemplary tubing hanger 30 installed in the adapter sleeve 24, the tubing head assembly 10 may comprise certain features to facilitate sealing the tubing hanger 30 to the adapter sleeve 24. For example, the adapter sleeve 24 may include an annular third sealing profile 50 configured to be sealingly engaged by a second sealing element 52 on the tubing hanger 30 to therefore seal the annulus between the adapter sleeve and the tubing hanger from pressure in the well bore. In some embodiments the third sealing profile 50 may be formed or otherwise located in the sleeve bore 26. As with the first and second sealing profiles 36, 40, the third sealing profile 50 may be defined a specific annular area of the sleeve bore 26, by a surface treatment or cladding which is applied to a specific annular area of the sleeve bore, or by a separate component which is mounted in the sleeve bore.

In the example shown in FIG. 5, the second sealing element 52 is shown to comprise a generally U-shaped cross section having a radially outer arm which is configured to sealingly engage the third sealing profile 50. In this example, the second sealing element 52 may be retained on the tubing hanger 30 using a retainer ring 54, and the radially outer arm may be maintained in engagement with the third sealing profile 50 by means of an energizing ring 56. As shown best in FIG. 1, in certain embodiments the third sealing profile 50 may comprise a beveled or stepped configuration to aid in energizing the second sealing element 52 as the tubing hanger 30 is landed in the adapter sleeve 24.

Referring still to FIGS. 1 and 5, the tubing head assembly 10 may also include certain features to facilitate securing the tubing hanger 30 to the adapter sleeve 24. For example, the adapter sleeve 24 may comprise a second locking profile 58 configured to be engaged by a second locking element 60 supported on the tubing hanger 30. In some embodiments the second locking profile 58 may be formed or otherwise located in the sleeve bore 26. The second locking element 60 may comprise a radially expandable lock ring or a plurality of locking dogs. In addition, the second locking element 60 may be forced radially into operative engagement with the second locking profile 58 by a second locking mandrel 62 which is slidably supported on the tubing hanger 30. The second locking mandrel 62 may be moved into operative engagement with the second locking element 60 by any suitable means, such as the aforementioned tubing hanger running tool or installation tool.

In particular flow completion systems in which the tubing hanger 30 is required to be oriented to the tubing head 20, the tubing head assembly 10 may include means for orienting the adapter sleeve 24 to the tubing head 20 and/or means for orienting the tubing hanger 30 to the adapter sleeve. As shown in FIG. 1, one example of a means for orienting the adapter sleeve 24 to the tubing head 20 may include a key 64 supported on the adapter sleeve 24 and a corresponding slot 66 formed in the central bore 22. In this embodiment, the positions of the key 64 and the slot 66 are selected such that when the key is positioned in the slot, the adapter sleeve 24 will be in a desired orientation relative to the tubing head 20.

In some embodiments, the key 64 may be retractable, in which event the means for orienting the adapter sleeve 24 to the tubing head 20 may also include a biasing element 68, such as a spring, for biasing the key radially outwardly. In this manner, after the adapter sleeve 24 is positioned in the central bore 22, the adapter sleeve may be rotated relative to the tubing head 20 until the key 64 enters the slot 66, at which point the adapter sleeve will be properly oriented relative to the tubing head. As shown in FIG. 1, the slot 66 may be recessed in the central bore 22. In this manner, the slot 66 will not restrict the central bore or prevent full bore access to the wellhead bore 14.

In an alternative embodiment, the key 64 may be supported on the tubing head 20 and the slot 66 may be located on the adapter sleeve 24. In another alternative embodiment, the means for orienting the adapter sleeve 24 to the tubing head 20 may include an orientation helix formed in the central bore 22 and a corresponding guide pin located on the adapter sleeve 24. Alternatively, the orientation helix may be formed on the adapter sleeve 24 and the guide pin may be located in the central bore 22.

The tubing head assembly 10 may in certain embodiments also comprise means for orienting the tubing hanger 30 to the adapter sleeve 24. Such means may comprise, for example, an orientation helix 70 which is located on the adapter sleeve 24 and is configured to be engaged by a guide pin (not shown) on the tubing hanger 30. In some embodiments the orientation helix 70 may be formed or otherwise located in the sleeve bore 26. In combination with the means described above for orienting the adapter sleeve 24 to the tubing head 20, the means for orienting the tubing hanger 30 to the adapter sleeve will thus ensure that the tubing hanger is properly oriented to the tubing head.

In an alternative embodiment which is not shown in the drawings, the means for orienting the tubing hanger 30 to the adapter sleeve 24 may comprise an orientation helix formed on or connected to the tubing hanger and a guide pin located on the adapter sleeve, such as in the sleeve bore 26. In yet another alternative embodiment, the means for orienting the tubing hanger 30 to the adapter sleeve 24 may include a key and slot arrangement of the type described above. In this embodiment, a key similar to the key 64 may be located on one of the adapter sleeve 24 and the tubing hanger 30 and a slot similar to the slot 66 may be located on the other of the adapter sleeve and the tubing hanger.

In the specific embodiment of the tubing head assembly 10 shown in FIGS. 1-5, the adapter sleeve 24 is supported on a load component located in the wellhead 12. In this embodiment, the adapter sleeve 24 is supported on the casing hanger 16 installed in the wellhead bore 14. The casing hanger 16 is in turn supported on the landing shoulder 18, although in other embodiments it may be supported on one or more intermediate casing hangers or components which in turn are supported on the landing shoulder. As a result, the load imparted on the adapter sleeve 24 from the tubing hanger 30 and its associated tubing string will be transmitted through the adapter sleeve and into the wellhead 12. In some embodiments, such as the embodiment shown in FIG. 1, the adapter sleeve 24 includes a downwardly facing load shoulder 72 configured to engage an upwardly facing landing seat 74 on the casing hanger 16. In alternative embodiments, the adapter sleeve 24 may be supported, e.g., directly on the landing shoulder 18.

In certain flow completion systems in which access to the tubing annulus is required or desired, the adapter sleeve 24 may be provided with a first bypass bore 76 that extends laterally from the sleeve bore 26 to a radially outer portion of the adapter sleeve which, when the adapter sleeve is installed in the tubing head 20, communicates with the annulus between the adapter sleeve and the tubing head. For example, the first bypass bore 76 may extend from a part of the sleeve bore 26 located below the third sealing profile 50 to a radially outer portion of the adapter sleeve 24 located below the first sealing profile 36. In this manner, when the tubing hanger 30 is positioned in the adapter sleeve and the adapter sleeve is positioned in the tubing head 20, the first bypass bore 76 will extend between a part of the sleeve bore 26 located below the second sealing element 52 and a part of the central bore 22 located below the first sealing element 38.

In addition, the tubing head assembly 10 may be configured such that the first bypass bore 76 communicates with a second bypass bore 78 that extends through the tubing head 20 from the central bore 22. In certain embodiments, the second bypass bore 78 may communicate with a part of the central bore 22 located above the first sealing element 38. In some embodiments the second bypass bore 78 may extend to an outer diameter surface of the tubing head 20. In particular embodiments the tubing head 20 may comprise a bypass valve 80 for controlling flow through the second bypass bore 78. In this embodiment, the second bypass bore 78 extends to the bypass valve 80, which may be mounted, e.g., on the outer diameter surface of the tubing head 20 (as shown in FIG. 1) or in the body of the tubing head. In a more specific embodiment, the second bypass bore 78 may comprises a first branch 82 which extends from the central bore 22 bore to the bypass valve 80 and a second branch 84 which extends from the bypass valve to a part of the central bore located above the first sealing element 38. In certain embodiments, the second branch 84 may extend from the bypass valve 80 to a slot 86 formed in the central bore above the first sealing profile 36.

Referring still to FIGS. 1-5, in a more specific embodiment of the tubing head assembly 10 the adapter sleeve 24 may comprise a tubular body 88 having an inner diameter surface which defines at least part of the sleeve bore 26. In this embodiment, the landing shoulder 28, the third sealing profile 50 and the second locking profile 56 may be located on the inner diameter surface of the body 88. The body 88 also comprises an outer diameter surface portion 90 on which the second sealing profile 40 may be located, and a lateral support surface 92 on which the first sealing element 38 may be positioned. In this embodiment, the energizing mandrel 42 may be slidably supported on the body 88 above the first sealing element 38. In addition, the energizing mandrel 42 may comprise a lateral support surface 94 on which the first locking element 46 is supported, and the locking mandrel 48 may be slidably supported on the energizing mandrel above this lateral support surface. Furthermore, the key 64 may be supported on the body 88, and the first bypass bore 76 may be formed in the body.

In certain embodiments, the adapter sleeve 24 may include a cylindrical load nut 96 which is axially movably supported on the body 88. For example, the load nut 96 may be threadedly connected to the body 88 such that rotation of the load nut relative to the body will result in axial movement of the load nut relative to the body. In this example, the load shoulder 72 may be formed on the load nut 96. In this manner, the load nut 96 may be rotated relative to the body 88 to adjust the axial space-out of the adapter sleeve 24 relative to the tubing head 20 (i.e., the axial distance between the load shoulder 72 on the adapter sleeve and the locking profile 44 on the tubing head 20).

In the specific embodiment of the tubing head assembly 10 shown in FIG. 1, the tubing head 20 is designed such that the central bore 22 ideally does not include any features which could limit full bore access to the wellhead bore 14, such as load shoulders, trigger shoulders or exposed seal bores (which are typically formed on or adjacent reduced diameter shoulders in the bore). To the contrary the first sealing profile 36 is approximately flush with or recessed in the central bore 22. Similarly, the first locking profile 44 and the slot 66 are recessed from the central bore 22. Also, in certain embodiments the nominal diameter of the central bore 22 is approximately the same as that of the wellhead bore 14. As a result, the tubing head 20 is capable of providing full bore access to the wellhead bore 14, which will facilitate drilling of the well bore through the tubing head.

Figure 2:
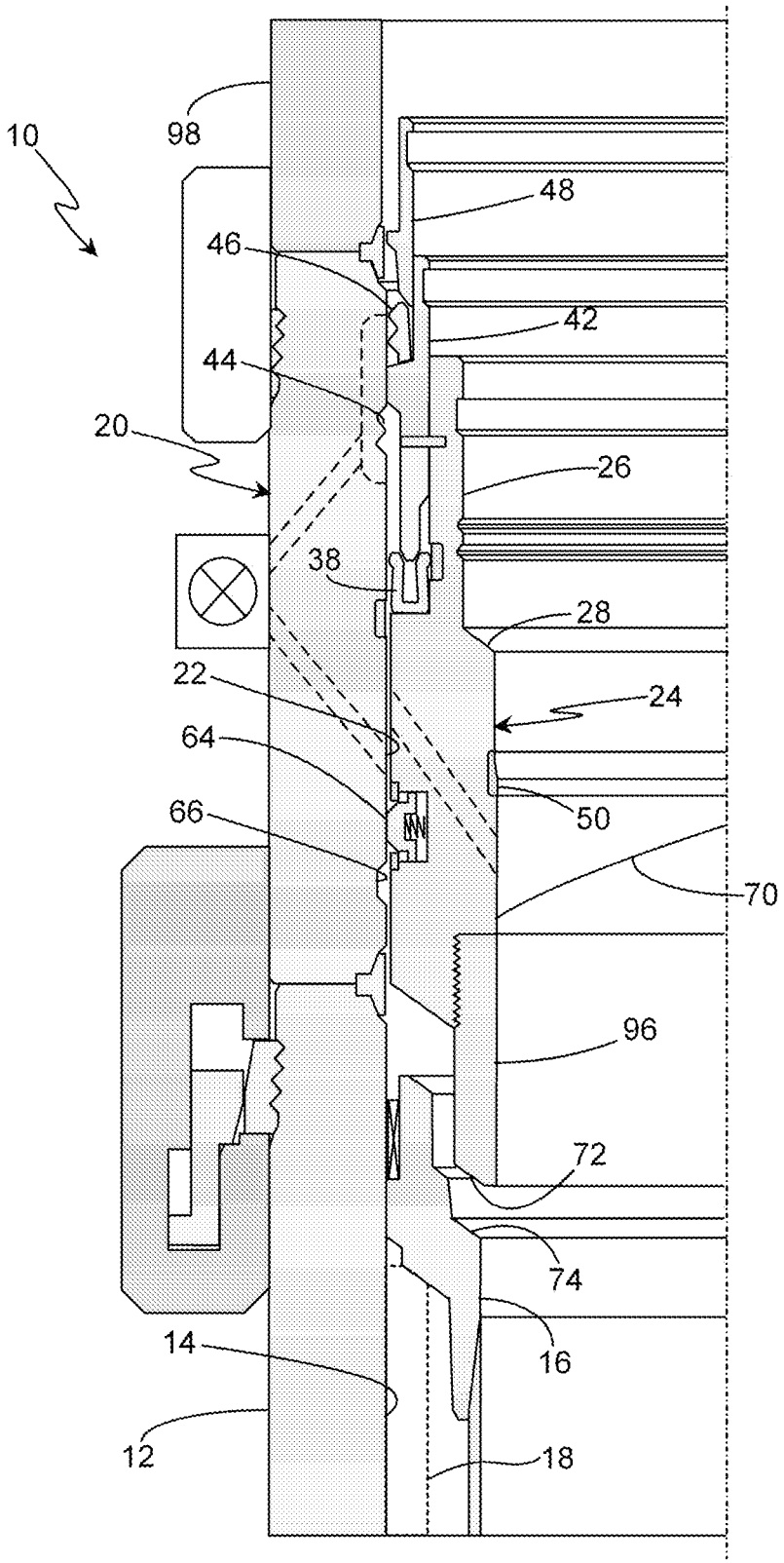
FIGS. 2-5 are a sequence of cross sectional views illustrating a method for installing a tubing hanger using the tubing head assembly of FIG. 1.

The present disclosure is also directed to a method of installing the tubing head assembly 10, one embodiment of which will be described with reference to FIGS. 2-5. As a first step, the tubing head 20, without the adapter sleeve 24 installed therein, is connected to the top of the wellhead 12 and a BOP 98 is connected to the top of the tubing head. In accordance with one embodiment, a suitable installation tool (not shown) is then connected to the adapter sleeve 24, after which the adapter sleeve is lowered through the BOP 98 and into the tubing head 20, as shown in FIG. 2. In embodiments in which the adapter sleeve 24 includes a retractable key 64, contact with the central bore 22 will force they key radially inwardly as the adapter sleeve is lowered through the central bore.

Figure 3:
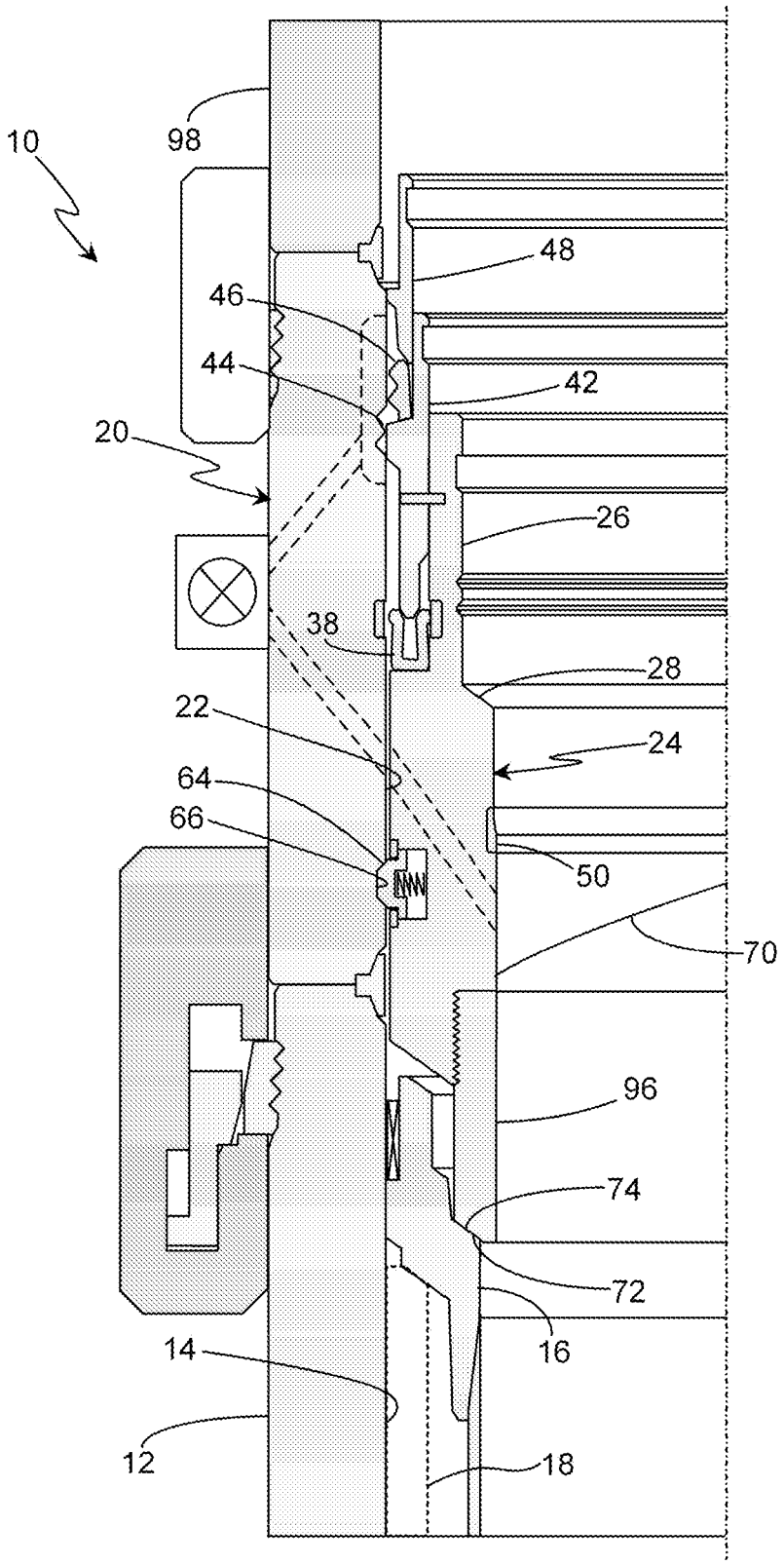

Referring to FIG. 3, the adapter sleeve 24 is lowered into the tubing head 20 until the load shoulder 72 on the adapter sleeve engages the landing seat 74 on the casing hanger 16 (or other load component located in the wellhead 12, as discussed above). At this point, in embodiments in which the tubing head assembly 10 includes means for orienting the adapter sleeve 24 relative to the tubing head 20 and such means comprises a key 64 and slot 66 arrangement, the adapter sleeve 24 may be rotated (by means of a landing string connected to the installation tool, for instance) until the key enters the slot to thereby ensure that the adapter sleeve 24 is in its proper orientation relative to the tubing head.

Figure 4:
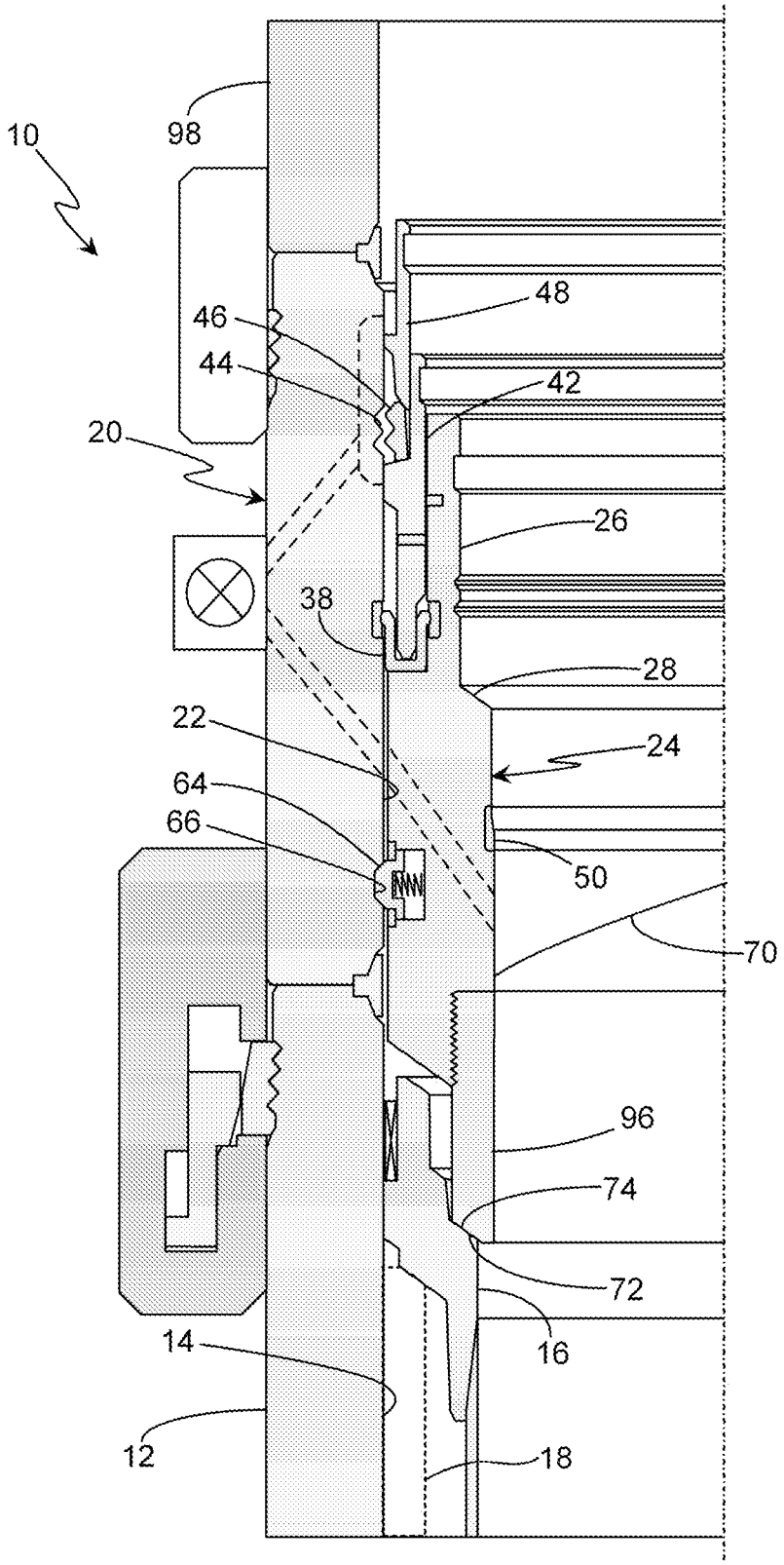

Referring to FIG. 4, in certain embodiments the energizing mandrel 42 may then be actuated to force the sealing element 38 into sealing engagement with the first and second sealing profiles 36, 40 (or with just the first sealing profile 36 if the sealing element 38 is so configured), after which the first locking mandrel 48 may be actuated to force the first locking element 46 radially outwardly into operative engagement with the first locking profile 44 to thereby secure the adapter sleeve 24 to the tubing head 20. This is the position shown in FIG. 1. If required or desired, shear pins may be employed to maintain the energizing mandrel 42 and/or the locking mandrel 48 in their initial, raised positions prior to being actuated.

In the present embodiment the tubing hanger 30 is installed in the adapter sleeve 24 after the adapter sleeve is installed in the tubing head 20. During this step, the tubing hanger 30 is connected to a suitable installation tool (not shown) and lowered through the BOP 98 and into the sleeve bore 26. Referring to FIG. 5, as the tubing hanger 30 is lowered through the sleeve bore 26, the second sealing element 52 will come into engagement with the third sealing profile 50, after which the tubing hanger will land on the landing shoulder 28. The second locking mandrel 62 may then be actuated to force the second locking element 60 radially outwardly into operative engagement with the second locking profile 58 to thereby secure the tubing hanger 30 to the adapter sleeve 24 and, thus, to the tubing head 20. After the tubing hanger 30 is fully installed in the adapter sleeve 24 and any required seal tests and other procedures are performed, the BOP 98 may be removed and replaced with a christmas tree (not shown).

In an alternative embodiment, the tubing hanger 30 may be connected to the adapter sleeve 24 prior to the adapter sleeve being installed in the tubing head 20. In this embodiment, the tubing hanger 30 is connected to a suitable installation tool, lowered into the sleeve bore 26 until it lands on the landing shoulder 28, and then locked to the adapter sleeve 24 by actuating the second locking mandrel 62 to force the second locking element 60 radially outwardly into the second locking profile 58. These steps may be performed on a surface vessel.

In this alternative embodiment, the tubing hanger 30 with the adapter sleeve 24 connected thereto is then lowered through the BOP 98 into the central bore 22 until the until the load shoulder 72 on the adapter sleeve engages the landing seat 74 on the casing hanger 16 (or other load component located in the wellhead 12, as discussed above). At this point, the adapter sleeve 24 may be rotated (by means of a landing string connected to the installation tool, for instance) until the key 64 enters the slot 66 to thereby ensure that the adapter sleeve is in its proper orientation relative to the tubing head 20. The energizing mandrel 42 may then be actuated to force the sealing element 38 into sealing engagement with the first and second sealing profiles 36, 40 (or with just the first sealing profile 36 if the sealing element 38 is so configured), after which the first locking mandrel 48 is actuated to force the first locking element 46 radially outwardly into operative engagement with the first locking profile 44 to thereby secure the adapter sleeve 24, and thus the tubing hanger 30, to the tubing head 20.

In order to retrieve the tubing hanger 30 from the tubing head 20, a suitable retrieval tool (not shown) may be connected to the tubing hanger, the energizing mandrel 42 and the first locking mandrel 48. If the first locking mandrel 48 is slidably connected to the energizing mandrel 42 (e.g., using the hook means described below in connection with the embodiment of FIG. 11), the retrieval tool need only be connected to the first locking mandrel. The energizing mandrel 42 and the first locking mandrel 48 may then be lifted upwards to unlock the adapter sleeve 24 from the tubing head 20 and deenergize or disengage the first sealing element 38 from the first sealing profile 36. With the adapter sleeve 24 still locked to the tubing hanger 30 (via engagement of the second locking element 60 with the second locking profile 58), the tubing hanger may be pulled upward and retrieved to the surface. During this action, the upward movement of the adapter sleeve 24 within the central bore 22 of the tubing head 20 will cause the key 64 to cam against the top of the slot 66 and retract into the adapter sleeve.

The tubing hanger 30 and the adapter sleeve 24 may also be retrieved independently. In this example, a suitable retrieval tool (not shown) is connected to the tubing hanger 30 and the second locking mandrel 62 is lifted to thereby unlock the tubing hanger from the adapter sleeve 24, after which the tubing hanger may be retrieved to the surface. Then, a suitable retrieval tool (not shown) is secured to the energizing mandrel 42 and the first locking mandrel 48. If the first locking mandrel 48 is slidably connected to the energizing mandrel 42 (e.g., using the hook means described below in connection with the embodiment of FIG. 11), the retrieval tool need only be connected to the first locking mandrel. The energizing mandrel 42 and the first locking mandrel 48 may then be lifted upwards to unlock the adapter sleeve 24 from the tubing head 20 and deenergize or disengage the first sealing element 38 from the first sealing profile 36. At this point, the adapter sleeve 24 is free of the central bore 22 and may be retrieved to the surface.

In the embodiments described above, the tubing head assembly 10 is configured to support the tubing hanger 30 in the wellhead 12. However, in certain flow completion systems, size constraints or other limitations may make it impractical or undesirable to support the tubing hanger 30 in the wellhead 12. In accordance with further embodiments of the disclosure, therefore, a tubing head assembly is provided which is configured to support the tubing hanger directly in the tubing head 20. In this embodiment, the weight of the tubing hanger and its associated tubing string is transmitted through the adapter sleeve to the tubing head and then from the tubing head to the wellhead.

An illustrative embodiment of such a tubing head assembly is shown in FIGS. 6-11. The tubing head assembly of this embodiment, which is indicated generally by reference number 100, is similar in many respects to the tubing head assembly 10 described above. Accordingly, the same reference numbers may be used to denote similar components in the description that follows.

In the present embodiment, the tubing head assembly 100 comprises a tubing head 20 and an adapter sleeve 24 which is configured to be secured and sealed in the tubing head. The tubing head 20 may be similar in most respects to the tubing head 20 described above. Accordingly, the tubing head 20 may include a central bore 22, an annular first sealing profile 36 located in the central bore, and an annular first locking profile 44 located in the central bore. The tubing head 20 may also include means for orienting the adapter sleeve 24 to the tubing head, such as a slot 66 configured to be engaged by a key 64 supported on the adapter sleeve 24, as described above. Also, the tubing head 20 may be secured to the wellhead 12 by any suitable arrangement, such as by means of a conventional hydraulic connector 32. In the present embodiment of the tubing head assembly 100, the tubing head 20 additionally includes an annular groove 102 formed or otherwise located in the central bore 22, the purpose of which will be made apparent below.

The adapter sleeve 24 of the present embodiment may include many of the features of the adapter sleeve 24 described above. Accordingly, the adapter sleeve 24 may include an axially extending sleeve bore 26 which is configured to receive the tubing hanger 30. The adapter sleeve 24 may also include an annular landing shoulder 28 on which the tubing hanger 30 is supported. The landing shoulder 28 may be located, e.g., in the sleeve bore 26. In other embodiments, the adapter sleeve 24 may be configured such that the tubing hanger 30 extends through the sleeve bore 26 and is supported on a load component located in the wellhead 12.

In certain embodiments the adapter sleeve 24 may also include an annular first sealing element 38 configured to sealingly engage the first sealing profile 36 to thereby seal the annulus between the tubing head 20 and the adapter sleeve against pressure in the well bore. Depending on the configuration of the first sealing element 38, the adapter sleeve 24 may also comprise an annular second sealing profile 40 configured for sealing engagement by the first sealing element.

Figure 11:
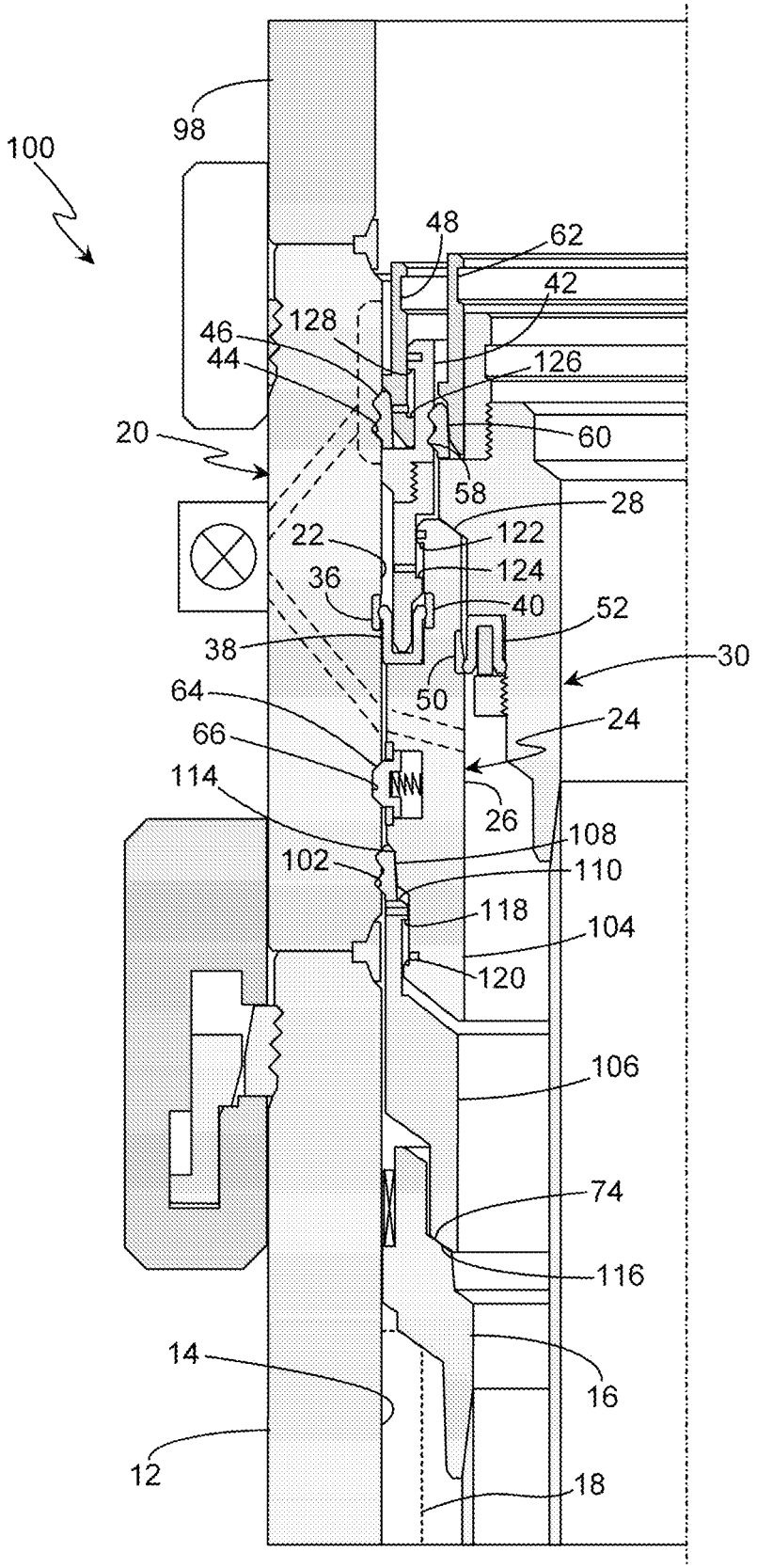

In some embodiments the adapter sleeve 24 may additionally include one or more of an energizing mandrel 42 for forcing the first sealing element 38 into sealing engagement with the first sealing profile 36 (or with both the first and second sealing profiles 36, 40 if the first sealing element is so configured), a first locking element 46 configured to engage the first locking profile 44 to thereby secure the adapter sleeve to the tubing head 20, a first locking mandrel 48 for forcing the first locking element into operative engagement with the first locking profile, and an annular third sealing profile 50 for sealing engagement by an annular second sealing element 52 on the tubing hanger 30 (see FIG. 11). In certain aspects, the adapter sleeve 24 may also include means for orienting the tubing hanger 30 to the adapter sleeve 24. Such means may comprise, for example, an orientation helix 70 which is located in the sleeve bore 26 and is configured to be engaged by a guide pin (not shown) on the tubing hanger 30.

As in the previous embodiment, the adapter sleeve 24 may also include a second locking profile 58 configured to be engaged by a second locking element 60 supported on the tubing hanger 30 to thereby secure the tubing hanger to the adapter sleeve. In this regard, the tubing hanger 30 may include a second locking mandrel 62 for forcing the second locking element 60 into engagement with the second locking profile 58 (see FIG. 11). The second locking profile 58 may be formed or otherwise located in the sleeve bore 26. In the example shown in FIG. 6, for example, the second locking profile 58 is formed on an inner diameter surface portion of the energizing mandrel 42.

Figure 6:
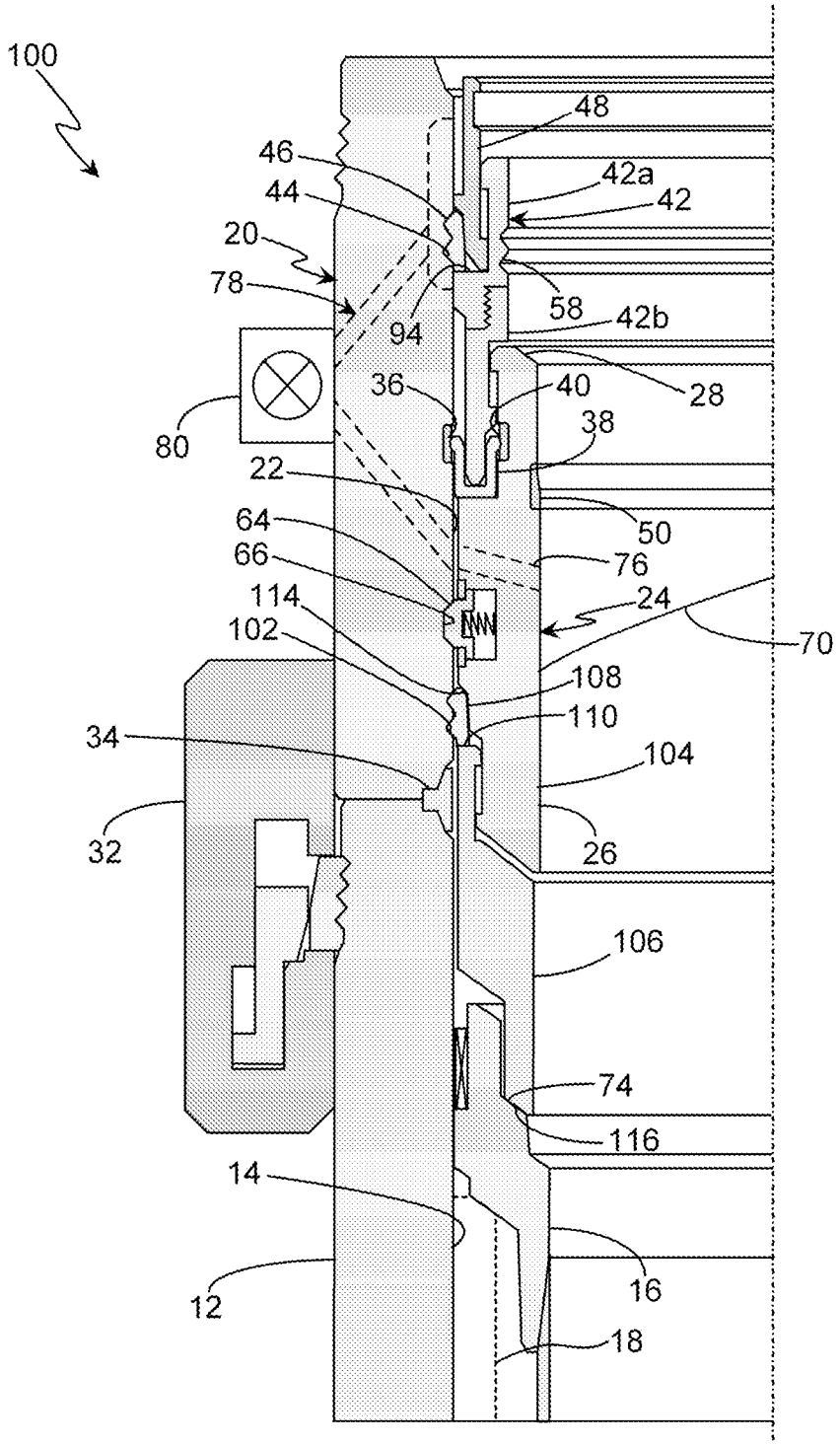
FIG. 6 is a cross sectional view of another illustrative embodiment of a tubing head assembly of the present disclosure shown mounted to a wellhead.

Referring still to FIG. 6, the adapter sleeve 24 of the current embodiment may also include a tubular body portion 104 on which the tubing hanger landing shoulder 28 is located, a trigger sleeve 106 which is positioned below the body portion, and a load ring 108 which is radially moveably supported on an upwardly facing trigger shoulder 110 located on the trigger sleeve (e.g., on an upper end portion of the trigger sleeve). The load ring 108 is configured to engage the groove 102 in the central bore 22 of the tubing head 20.

The body portion 104 is slidably supported relative to the trigger sleeve 106 and, in certain aspects, may function as an actuating mandrel for the load ring 108. As seen best in FIG. 7, for example, the body portion 104 may comprise a radially outwardly directed actuating surface 112 which in a first or raised position of the body portion (shown in FIG. 7) is located above the load ring 108 and in a second or lowered position of the body portion (shown in FIG. 6) is located at least in part radially adjacent the load ring. The actuating surface 112 is configured such that, when the body portion 104 is moved axially downwardly relative to the trigger sleeve 106 from its first position to its second position, the actuating surface will force the load ring 108 radially outwardly into engagement with the groove 102. The arrangement for moving the body portion 104 from its first position to its second position will be described below.

In this embodiment the body portion 104 may also include a downwardly directed load shoulder 114 which is configured to engage the load ring 108 when the body portion is in its second position and the load ring is engaged with the groove 102. The load shoulder 114 may be located above the actuating surface 112, such as at an upper end of the actuating surface. In this manner, when the body portion 104 is in its second position and the load ring 108 is engaged with the groove 102, the weight of the tubing hanger 30 will be transmitted through the load shoulder 114 and the load ring 108 to the tubing head 20.

In some embodiments the energizing mandrel 42 may include an upper mandrel part 42*a* which is axially movably connected to a lower mandrel part 42*b*. For example, the upper mandrel part 42*a* may be threadedly connected to the lower mandrel part 42*b* such that rotation of the upper mandrel part relative to the lower mandrel part will result in axial movement of the upper mandrel part relative to the lower mandrel part. In this manner, the upper mandrel part 42*a* may be rotated relative to the lower mandrel part 42*b* to adjust the axial space-out of the adapter sleeve 24 relative to the tubing head 20 (i.e., the axial distance between the load shoulder 114 on the adapter sleeve and the first locking profile 44 on the tubing head 20).

Referring still to FIG. 6, in the present embodiment the trigger sleeve 106 may comprise a downwardly directed triggered shoulder 116 configured to engage a trigger component located in the wellhead 12. The trigger component may comprise, e.g., the casing hanger 16 (such as the upwardly directed landing seat 74 on the casing hanger), an intermediate casing hanger (not shown), or the load shoulder 18. As a result, as the adapter sleeve 24 is lowered into the tubing hanger 20, the trigger shoulder 116 will engage the trigger component and the trigger component will arrest the downward movement of the trigger sleeve 106. The significance of this aspect of the tubing head assembly 100 will be made apparent below.

Figure 7:
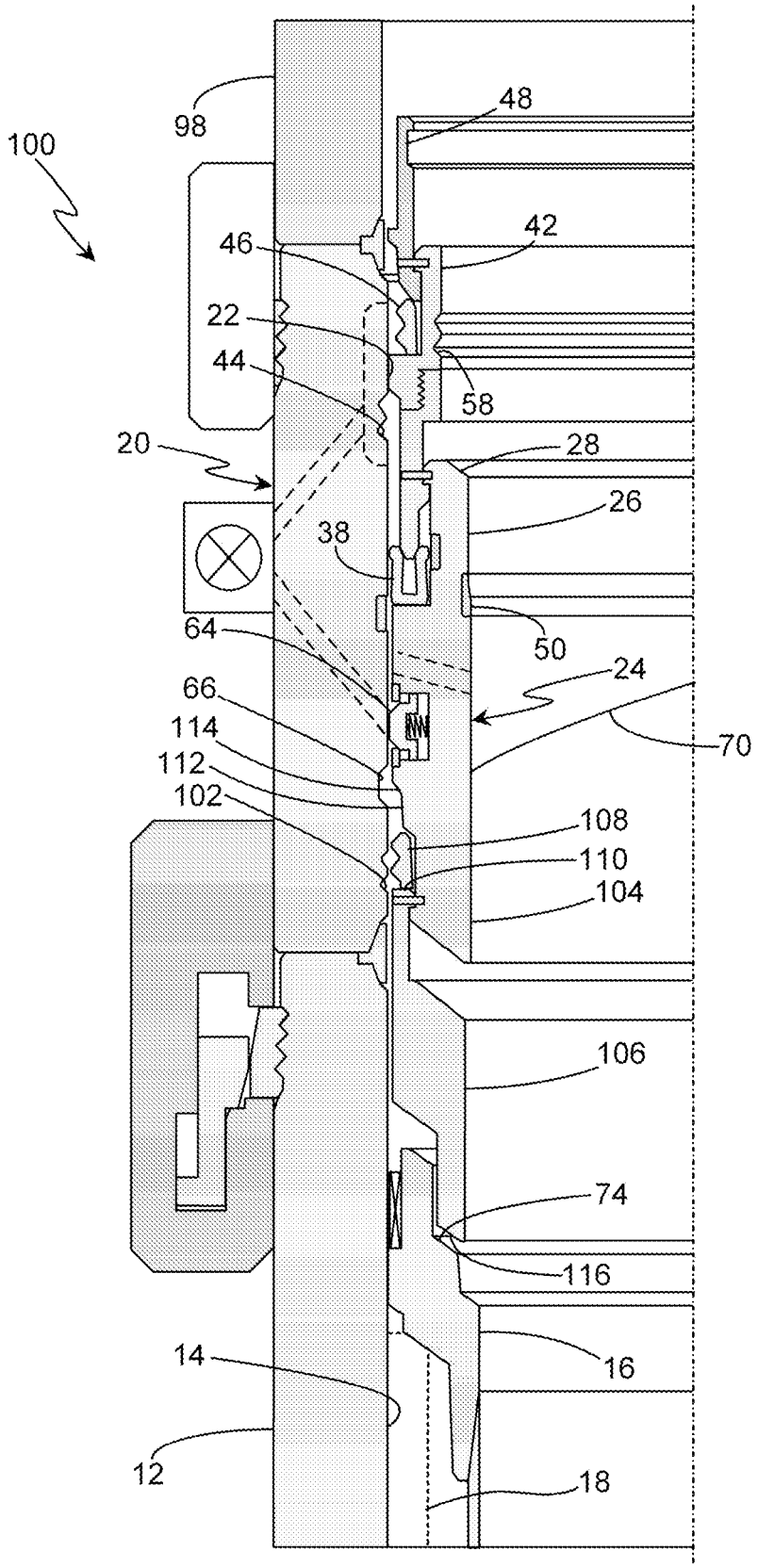
FIGS. 7-11 are a sequence of cross sectional views illustrating a method for installing a tubing hanger using the tubing head assembly of FIG. 6.

One exemplary method of installing the tubing head assembly 100 will be described with reference to FIGS. 7-11. As a first step, the tubing head 20 is connected to the top of the wellhead 12 and a BOP 98 is connected to the top of the tubing head. A suitable installation tool (not shown) is then connected to the adapter sleeve 24 and the adapter sleeve is lowered through the BOP 98 and into the tubing head 20, as shown in FIG. 7. During this step, the body portion 104 is in its first or upper position relative to the trigger sleeve 106. The body portion 104 may be held in this position by use of any suitable means, such as a number of shear pins.

Figure 8:
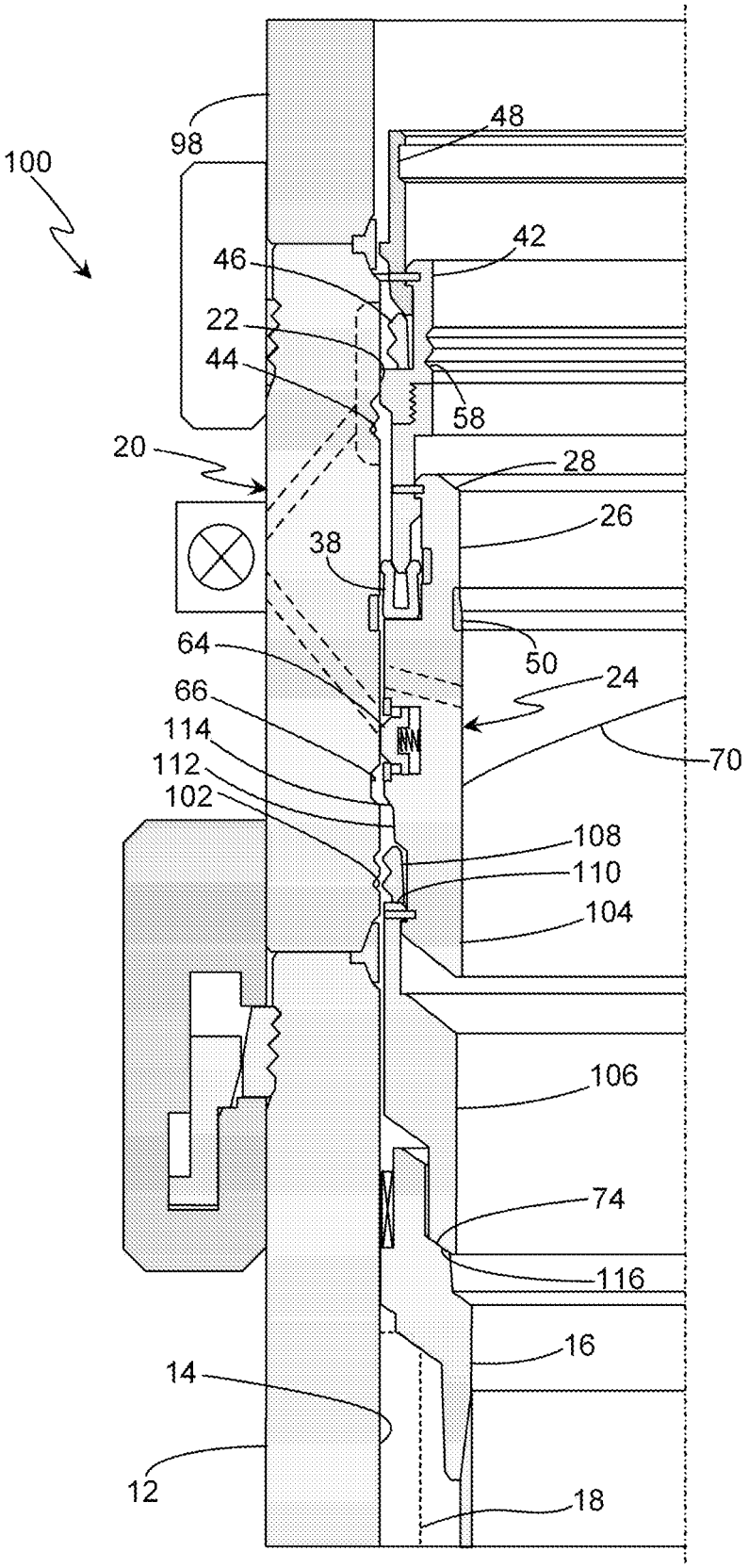

As shown in FIG. 8, the adapter sleeve 24 is lowered into the tubing head 20 until the trigger shoulder 116 on the trigger sleeve 106 engages the trigger component located in the wellhead 12, such as the landing seat 74 on the casing hanger 16. Once the trigger shoulder 116 engages the trigger component, further downward movement of the trigger sleeve 106 is prevented. In this position, the load ring 108 is located opposite the groove 102.

Figure 9:
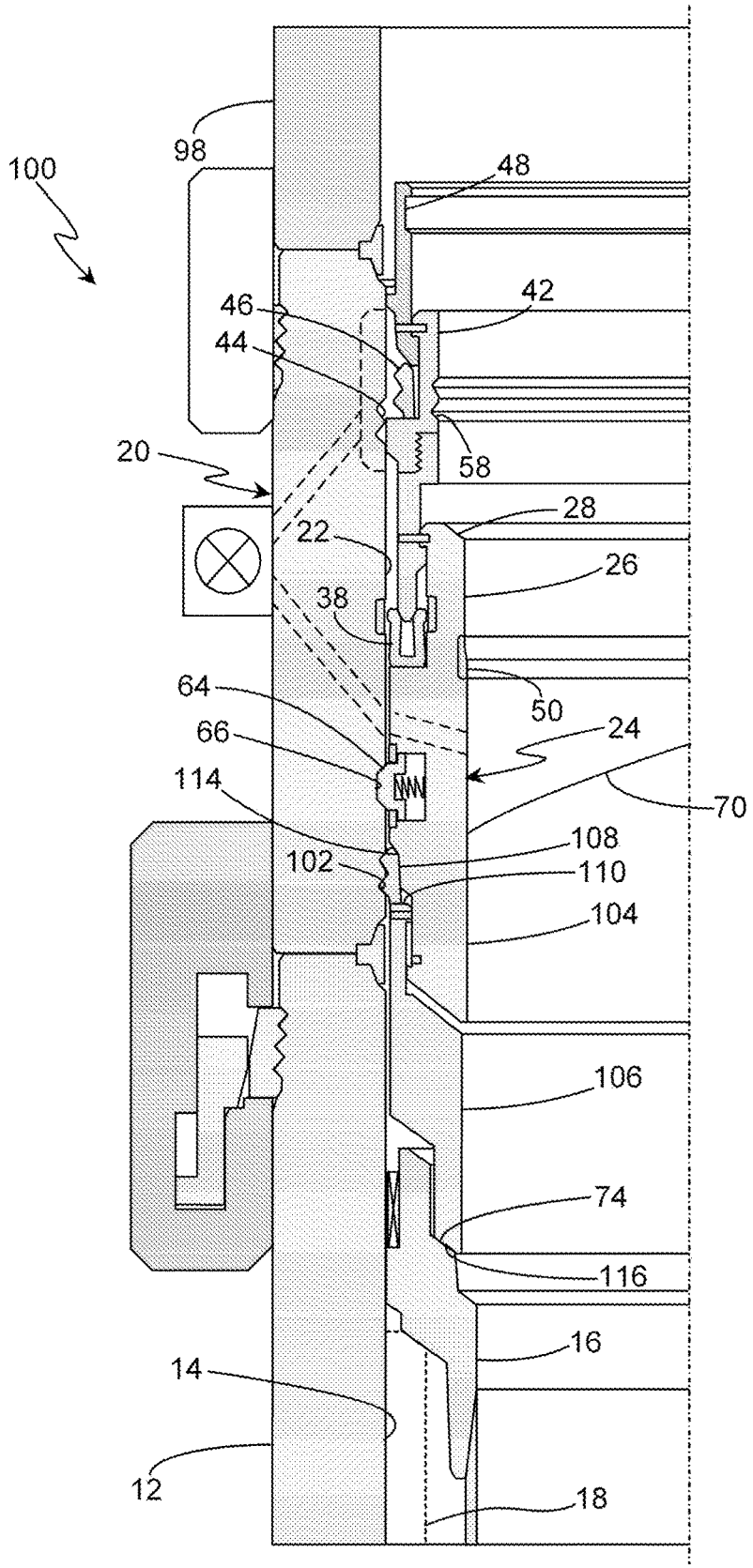

Referring to FIG. 9, continued downward movement of the adapter sleeve 24 through the tubing head 20 will cause the body portion 104 to move axially downwardly relative to the trigger sleeve 106 from its first or raised position (FIG. 8) to its second or lowered position (FIG. 9). During this movement, the actuating surface 112 on the body portion 104 will force the load ring 108 radially outwardly into the groove 102. Also, in embodiments in which the means for orienting the adapter sleeve 24 relative to the tubing head 20 comprises a key 64 and slot 66 arrangement, the adapter sleeve 24 may be rotated until the key enters the slot to thereby ensure that the adapter sleeve 24 is in its proper orientation relative to the tubing head.

Figure 10:
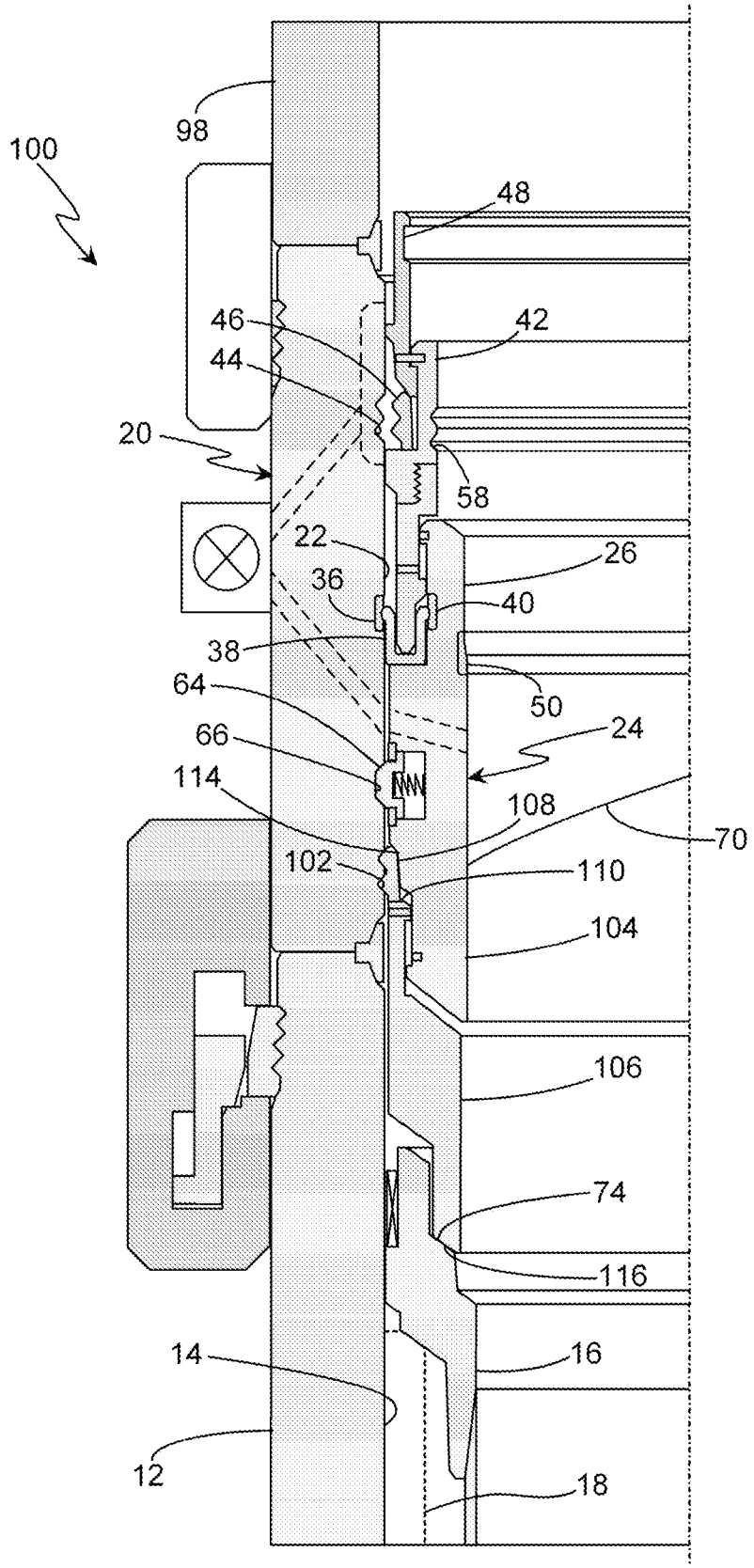

Referring to FIG. 10, the energizing mandrel 42 may then be actuated to force the sealing element 38 into sealing engagement with the first sealing profile 36 (or with the first and second sealing profiles 36, 40 if the sealing element is so configured), after which the first locking mandrel 48 may be actuated to force the first locking element 46 radially outwardly into operative engagement with the first locking profile 44 to thereby secure the adapter sleeve 24 to the tubing head 20. This is the position shown in FIG. 6. If required or desired, shear pins may be employed to maintain the energizing mandrel 42 and/or the locking mandrel 48 in their initial, raised positions prior to being actuated.

In the present embodiment the tubing hanger 30 is installed in the adapter sleeve 24 after the adapter sleeve is installed in the tubing head 20. During this step, the tubing hanger 30 is connected to a suitable installation tool (not shown) and lowered through the BOP 98 and into the sleeve bore 26. Referring to FIG. 11, as the tubing hanger 30 is lowered through the sleeve bore 26, the second sealing element 52 will come into engagement with the third sealing profile 50, after which the tubing hanger will land on the landing shoulder 28. The second locking mandrel 62 may then be actuated to force the second locking element 60 radially outwardly into operative engagement with the second locking profile 58 to thereby secure the tubing hanger 30 to the adapter sleeve 24 and, thus, to the tubing head 20. After the tubing hanger 30 is fully installed in the adapter sleeve 24 and any required seal tests and other procedures are performed, the BOP 98 may be removed and replaced with a christmas tree (not shown).

In an alternative embodiment, the tubing hanger 30 may be assembled with the adapter sleeve 24 prior to being lowered into the tubing head 20. During this step, the tubing hanger 30 is connected to a suitable installation tool and lowered into the sleeve bore 26 until the second locking element 60 is positioned opposite the second locking profile 58, after which the second locking mandrel 62 is actuated to lock the tubing hanger to the adapter sleeve 24. In subsea applications, this step may be performed on the surface vessel. Then, the tubing hanger 30, with the adapter sleeve 24 connected thereto, is lowered through the BOP 98 and into the tubing head 20. During this step, the body portion 104 is in its first or upper position relative to the trigger sleeve 106. The body portion 104 may be held in this position by use of any suitable means, such as a number of shear pins.

In this alternative embodiment, the tubing hanger 30 is lowered into the tubing head 20 until the trigger shoulder 116 on the trigger sleeve 106 engages the trigger component located in the wellhead 12, such as the landing seat 74 on the casing hanger 16. Once the trigger shoulder 116 engages the trigger component, further downward movement of the trigger sleeve 106 is prevented. In this position, the load ring 108 is located opposite the groove 102. Continued downward movement of the tubing hanger 30 through the tubing head 20 will cause the body portion 104 to move axially downwardly relative to the trigger sleeve 106 from its first or raised position to its second or lowered position. During this movement, the actuating surface 112 on the body portion 104 will force the load ring 108 radially outwardly into the groove 102. Also, in embodiments in which the tubing head assembly 100 includes means for orienting the adapter sleeve 24 relative to the tubing head 20 and such means comprises a key 64 and slot 66 arrangement, the adapter sleeve 24 may be rotated until the key enters the slot to thereby ensure that the adapter sleeve 24 is in its proper orientation relative to the tubing head.

The energizing mandrel 42 may then be actuated to force the sealing element 38 into sealing engagement with the first sealing profile 36 (or with the first and second sealing profiles 36, 40 if the sealing element is so configured), after which the first locking mandrel 48 may be actuated to force the first locking element 46 radially outwardly into operative engagement with the first locking profile 44 to thereby secure the adapter sleeve 24, and thus the tubing hanger 30, to the tubing head 20. After the tubing hanger 30 and the adapter sleeve 24 are fully installed in the tubing head 20 and any required seal tests and other procedures are performed, the BOP 98 may be removed and replaced with a christmas tree (not shown).

Referring still to FIG. 11, the adapter sleeve 24 may in certain aspects include means to facilitate retrieval of the tubing hanger 30 from the tubing head 20. For example, the trigger sleeve 106 may comprise a first hook 118 which is configured to be engaged by a second hook 120 on the body portion 104, and the body portion may comprise a third hook 122 which is configured to be engaged by a fourth hook 124 on the energizing mandrel 42. In this manner, once the tubing hanger 30 has been unlocked from the tubing head 20 (by lifting the first locking mandrel 48 to release the first locking element 46 from the first locking profile 44), upward movement of the tubing hanger (which remains locked to the energizing mandrel 42 by engagement of the second locking element 60 with the second locking profile 58) will pull the energizing mandrel upward until the fourth hook 124 engages the third hook 122. Further upward movement of the tubing hanger 30 will cause the energizing mandrel to pull the body portion 104 upward until the load ring 108 is released from the groove 102 and the second hook 120 engages the first hook. At this point, the adapter sleeve 24 is free of the central bore 22 and the tubing hanger 30, with the adapter sleeve 24 secured thereto, may be retrieved to the surface.

In accordance with another embodiment, the tubing hanger 30 and the adapter sleeve 24 may be retrieved independently. In this example, a suitable retrieval tool (not shown) is connected to the tubing hanger 30 and the second locking mandrel 62 is lifted to thereby unlock the tubing hanger from the adapter sleeve 24, after which the tubing hanger may be retrieved to the surface. Then, a suitable retrieval tool (not shown) is secured to the first locking mandrel 48 and the first locking mandrel is lifted to unlock the adapter sleeve 24 from the central bore 22. Continued upward movement of the first locking mandrel 48 will bring a fifth hook 126 on the first locking mandrel into engagement with a sixth hook 128 on the energizing mandrel 42. At this point, continued upward movement of the first locking mandrel 48 will pull the energizing mandrel 42 upward until the fourth hook 124 on the energizing mandrel engages the third hook 122 on the body portion 104. Continued upward movement of the first locking mandrel 48 will then pull the body portion 104 upward until the load ring 108 is released from the groove 102 and the second hook 120 engages the first hook 118. At this point, the adapter sleeve 24 is free of the central bore 22 and may be retrieved to the surface.

Figure 12:
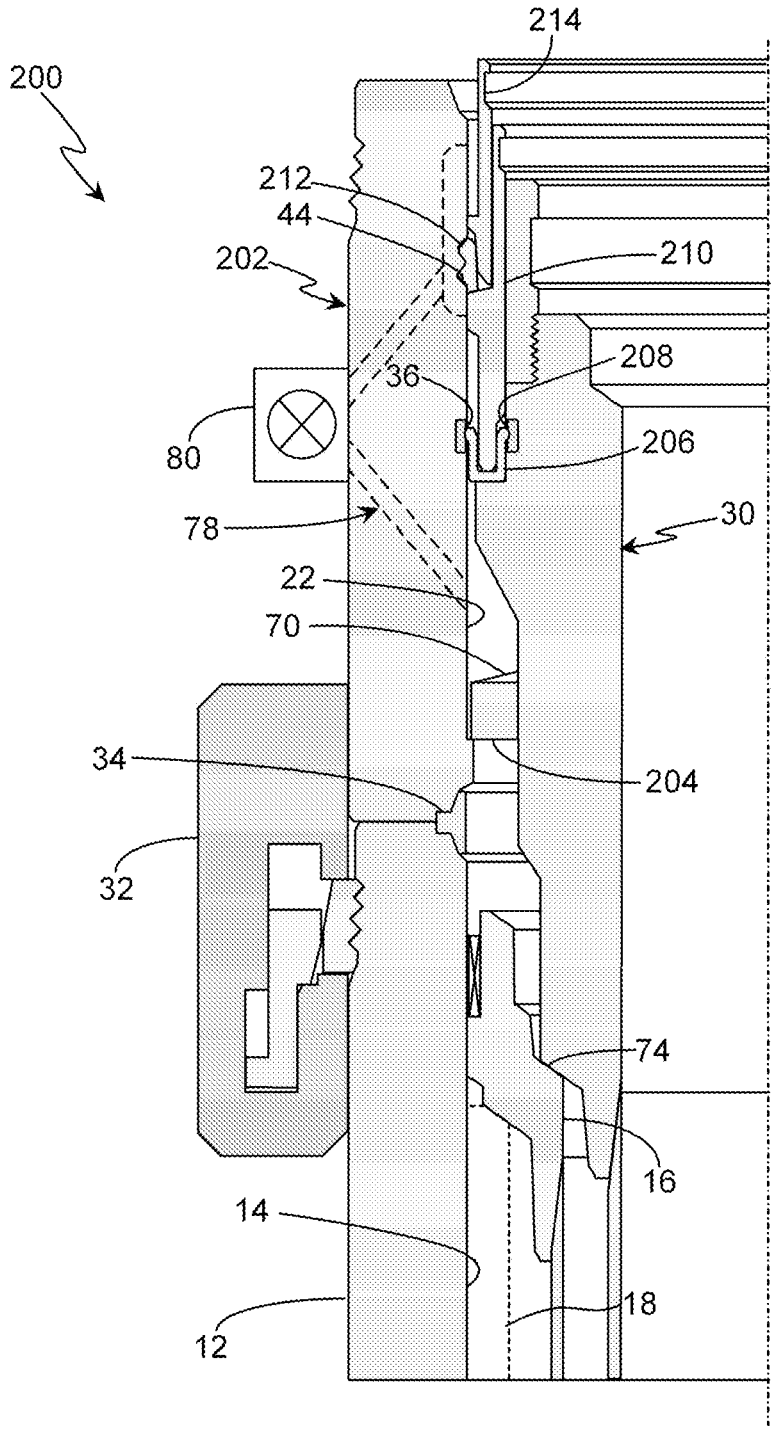
FIG. 12 is a cross sectional view of a further illustrative embodiment of a tubing head assembly of the present disclosure shown mounted to a wellhead.

Another embodiment of a tubing head assembly according to the present disclosure is shown in FIG. 12. The tubing head assembly of this embodiment, which is indicated generally by reference number 200, is particularly useful for housing full diameter tubing hangers without the use of an adapter sleeve of the type described above. The tubing head assembly 200 comprises a tubing head 202 which is similar in many respects to the tubing head 20 described above. For that reason, the same reference numbers may be used to denote similar components in the description that follows.

As shown in FIG. 12, the tubing head 202 includes a generally cylindrical central bore 22, an annular first sealing profile 36 located in the central bore, and an annular locking profile 44 located in the central bore. As discussed above, in certain embodiments the first sealing profile 36 may be approximately flush with or recessed in the central bore 22. The tubing head 202 may also include means to facilitate orienting the tubing hanger 30 to the tubing head, such as an orientation helix 70 (only a portion of which is visible) which is located in the central bore 22 and is configured to be engaged by a guide pin 204 on the tubing hanger 30. In addition, the tubing head 202 may include means for providing access to the annulus between the central bore 22 and the tubing hanger 30, such as a bypass port 78 and, in certain embodiments, a bypass valve 80 of the type described above.

The tubing head 202 is configured to be secured and sealed to a wellhead 12 by any suitable means, such as a conventional hydraulic connector 32 and a gasket 34. In this embodiment, the tubing hanger 30 is supported on a casing hanger 16 located in the wellhead 12. The casing hanger 16 may be supported, e.g., on a landing shoulder 18 (shown in phantom) formed on or secured to the wellhead bore 14, or on one or more intermediate casing hangers (not shown) which in turn are supported on the landing shoulder. As an alternative, the tubing hanger 30 may be supported directly on the landing shoulder 18.

In this embodiment, the tubing hanger 30 may include a sealing element 206 which is configured to sealingly engage the first sealing profile 36 to thereby seal the annulus between the tubing head 202 and the tubing hanger against pressure in the well bore. The tubing hanger 30 may also comprise one or more of an annular second sealing profile 208 which is configured to be sealingly engaged by the sealing element 206, an energizing mandrel 210 for energizing the sealing element 206 against the first sealing profile 36 (or against the first and second sealing profiles 36, 208, depending on the configuration of the sealing element), a locking element 212 which is configured to engage the locking profile 44 to thereby secure the tubing hanger to the tubing head 202, and a locking mandrel 214 for moving the locking element into engagement with the locking profile. These components may be similar in construction and operation to the like components described above.

As may be seen from FIG. 12, the tubing head 202 is designed such that the central bore 22 does not contain any load shoulders, trigger shoulders or exposed seal bores (which are typically formed on or adjacent reduced diameter steps in the bore) which could limit access to the wellhead bore 14. In addition, the central bore 22 may in certain embodiments be designed to comprise a nominal diameter approximately the same as the nominal diameter of the wellhead bore 14. As a result, the tubing head 202 is capable of providing full bore access to the wellhead bore 14, which will facilitate drilling of the well bore through the tubing head.

Figure 13:
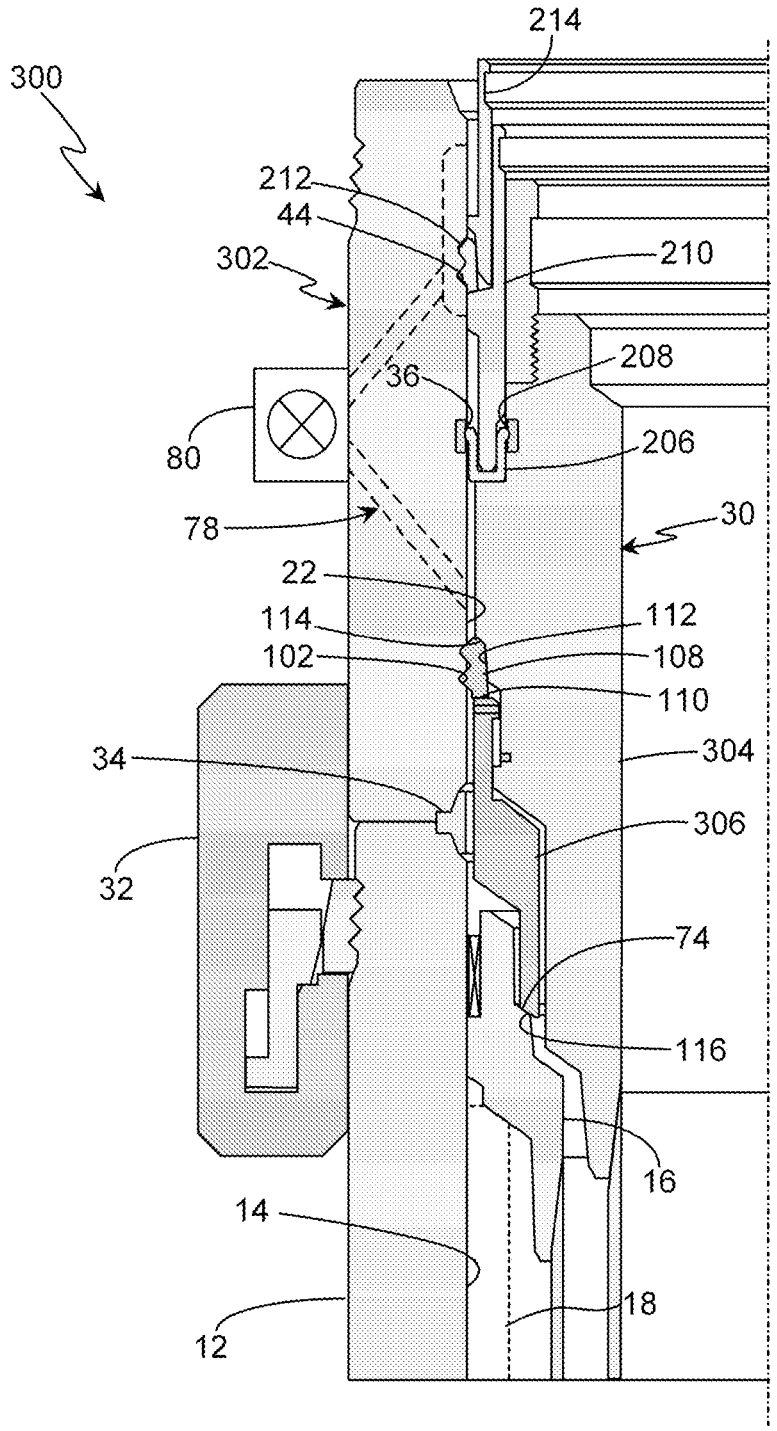
FIG. 13 is a cross sectional view of yet another illustrative embodiment of a tubing head assembly of the present disclosure shown mounted to a wellhead.

A further embodiment of a tubing head assembly according to the present disclosure is shown in FIG. 13. The tubing head assembly of this embodiment, which is indicated generally by reference number 300, combines certain aspects of the tubing head assemblies 100 and 200 described above. Similar to the tubing head assembly 200, the tubing head assembly 300 is configured to house a full diameter tubing hanger without the use of an adapter sleeve. And similar to the tubing head assembly 100, the tubing hanger 30 is supported by the tubing head rather than by a load component in the wellhead 12.

Referring to FIG. 13, the tubing head assembly 300 comprises a tubing head 302 which is similar in many respects to the tubing head 202 described above. Accordingly, the same reference numbers may be used to denote similar components in the description that follows. As shown in FIG. 13, the tubing head 302 includes a generally cylindrical central bore 22 having an annular first sealing profile 36 and an annular locking profile 44. The tubing head 302 may also include means to facilitate orienting the tubing hanger 30 to the tubing head, such as an orientation helix (not shown) in the central bore 22 which is configured to be engaged by a guide pin (not shown) on the tubing hanger. In addition, the tubing head 302 may include means for providing access to the annulus between the central bore 22 and the tubing hanger 30, such as a bypass port 78 and, in certain embodiments, a bypass valve 80 of the type described above.

In the present embodiment, the tubing hanger 30 is designed to be supported on a load ring 108 which is configured to be received in an annular groove 102 formed in the central bore 22. In particular, the tubing hanger 30 includes a tubular body portion 304 and a trigger sleeve 306 which is slidably supported on an outer diameter surface of the body portion. The trigger sleeve 306 is similar to the trigger sleeve 106 described above: it includes an upwardly facing trigger shoulder 110 on which the load ring 108 is radially movably supported and a downwardly directed triggered shoulder 116 which is configured to engage a trigger component located in the wellhead 12, such as, e.g., the landing seat 74 on the casing hanger 16.

As in the tubing head assembly 100 described above, the body portion 304 functions as an actuating mandrel for the load ring 108. Accordingly, the body portion 304 comprises a radially outwardly directed actuating surface 112 which in a first or raised position of the body portion is located above the load ring 108 and in a second or lowered position of the body portion (shown in FIG. 13) is located at least in part radially adjacent the load ring. The actuating surface 112 is configured such that, when the body portion 304 is moved downwardly relative to the trigger sleeve 306 from its first position to its second position, the actuating surface will force the load ring 108 radially outwardly into engagement with the groove 102.

In this embodiment the body portion 304 also includes a downwardly directed load shoulder 114 which is configured to engage the load ring 108 when the body portion is in its second position and the load ring is engaged with the groove 102. The load shoulder 114 may be located above the actuating surface 112, such as at an upper end of the actuating surface. In this manner, when the body portion 304 is in its second position and the load ring 108 is engaged with the groove 102, the weight of the tubing hanger 30 will be transmitted through the load shoulder 114 and the load ring 108 to the tubing head 20.

Similar to the tubing hanger in the embodiment of the tubing head assembly 200 shown in FIG. 12, the tubing hanger 30 may include a sealing element 206 which is configured to sealingly engage the first sealing profile 36 to thereby seal the annulus between the tubing head 302 and the tubing hanger against pressure in the well bore. The tubing hanger 30 may further comprise one or more of an annular second sealing profile 208 which is configured to be sealingly engaged by the sealing element 206, an energizing mandrel 210 for energizing the sealing element 206 against the first sealing profile 36 (or against the first and second sealing profiles 36, 208, depending on the configuration of the sealing element), a locking element 212 which is configured to engage the locking profile 44 to thereby secure the tubing hanger to the tubing head 302, and a locking mandrel 214 for moving the locking element into engagement with the locking profile. These components may be similar in construction and operation to the like components described above.

The tubing hanger 30 of this embodiment may be installed in the tubing head 302 by first connecting the tubing hanger to a suitable installation tool (not shown) and then lowering the tubing hanger into the tubing head until the trigger shoulder 116 on the trigger sleeve 306 engages the trigger component located in the wellhead 12, such as the landing seat 74 on the casing hanger 16. In this position, the load ring 108 is located opposite the groove 102. Continued downward movement of the tubing hanger 30 through the tubing head 302 will cause the body portion 304 to move axially downwardly relative to the trigger sleeve 106 from its first or raised position to its second or lowered position. During this movement, the actuating surface 112 on the body portion 104 will force the load ring 108 radially outwardly into the groove 102.

The energizing mandrel 210 may then be actuated to force the sealing element 206 into sealing engagement with the first sealing profile 36 (or with the first and second sealing profiles 36, 208 if the sealing element is so configured), after which the first locking mandrel 214 is actuated to force the first locking element 212 radially outwardly into operative engagement with the first locking profile 44 to thereby secure the tubing hanger 30 to the tubing head 302. After the tubing hanger 30 is fully installed in the tubing head 302 and any required seal tests and other procedures are performed, the BOP 98 may be removed and replaced with a christmas tree (not shown).

As may be seen from FIG. 13, the tubing head 302 is designed such that the central bore 22 does not contain any load shoulders, trigger shoulders or exposed seal bores (which are typically formed on or adjacent reduced diameter steps in the bore) which could limit access to the wellhead bore 14. In addition, the central bore 22 may in certain embodiments be designed to comprise a nominal diameter approximately the same as the nominal diameter of the wellhead bore 14. As a result, the tubing head 302 is capable of providing full bore access to the wellhead bore 14, which will facilitate drilling of the well bore through the tubing head.

It should be recognized that, while the present disclosure has been presented with reference to certain illustrative embodiments, those skilled in the art may develop a wide variation of structural and operational details without departing from the principles of the disclosure. For example, the various elements shown in the illustrative embodiments described above may be combined in a manner not specifically illustrated. Therefore, the following claims are to be construed to cover all equivalents falling within the true scope and spirit of the disclosure.

What is claimed is:

1. A tubing head assembly for housing a tubing hanger in a well completion system, the well completion system including a wellhead positioned at the upper end of a well bore and a christmas tree positioned above the wellhead, the tubing head assembly comprising:

a tubing head connectable to the top of the wellhead, the tubing head comprising an axially extending central bore; and a tubular adapter sleeve configured to be secured and sealed in the central bore, the adapter sleeve including an axially extending sleeve bore which is configured to receive the tubing hanger, wherein the adapter sleeve is not, in use, directly connected to a tubing string;

wherein in use of the tubing head assembly, the tubing hanger is positioned in the sleeve bore and the adapter sleeve is positioned in the central bore to thereby position the tubing hanger in the tubing head;

wherein the adapter sleeve comprises an annular tubing hanger landing shoulder, and wherein in use of the tubing head assembly the tubing hanger is supported on the tubing hanger landing shoulder;

wherein the tubing head comprises a first locking profile located in the central bore and the adapter sleeve comprises a first locking element which is engageable with the first locking profile to thereby secure the adapter sleeve to the tubing head;

wherein the tubing head comprises an annular first sealing profile located in the central bore and the adapter sleeve comprises a first sealing element which is configured to sealingly engage the first sealing profile to thereby seal an annulus between the central bore and the adapter sleeve; and wherein the adapter sleeve comprises a second locking profile located in the sleeve bore which is operatively engageable by a second locking element on the tubing hanger to thereby secure the tubing hanger to the adapter sleeve, and wherein the sleeve bore comprises an annular third sealing profile configured to be sealingly engaged by a second sealing element on the tubing hanger to thereby seal an annulus between the tubing hanger and the adapter sleeve.

2. The tubing head assembly of claim 1, wherein the wellhead comprises a wellhead bore having a first nominal diameter and the central bore has a second nominal diameter which is approximately the same as the first nominal diameter.

3. The tubing head assembly of claim 1, wherein the first sealing profile is approximately flush with or recessed in the central bore.

4. The tubing head assembly of claim 1, wherein the adapter sleeve comprises an annular second sealing profile and the first sealing element is configured to sealingly engage both the first and second sealing profiles to thereby seal the annulus between the central bore and the adapter sleeve.

5. The tubing head assembly of claim 1, further comprising means for orienting the adapter sleeve to the tubing head.

6. The tubing head assembly of claim 5, wherein the means for orienting the adapter sleeve to the tubing head comprises a key supported on the adapter sleeve and a corresponding slot formed in the central bore, and wherein the slot is positioned so as to receive the key when the adapter sleeve is in a predetermined orientation relative to the tubing head.

7. The tubing head assembly of claim 5, further comprising means for orienting the tubing hanger to the adapter sleeve.

8. The tubing head assembly of claim 1, wherein the adapter sleeve comprises a first bypass bore which extends from a part of the sleeve bore below the third sealing profile to a part of the central bore below the first sealing profile.

9. The tubing head assembly of claim 8, wherein the tubing head comprises a second bypass bore which extends from the part of central bore below the first sealing profile to a part of the central bore above the first sealing profile.

10. The tubing head assembly of claim 9, wherein the tubing head comprises a bypass valve and the second bypass bore comprises a first branch which extends from the part of the central bore below the first sealing profile to the bypass valve and a second branch which extends from the bypass valve to the part of the central bore above the first sealing profile, wherein the bypass valve is operable to open or close the first branch.

11. The tubing head assembly of claim 1, wherein the central bore comprises an annular groove and the adapter sleeve comprises:

a tubular body portion on which the tubing hanger landing shoulder is located, the body portion comprising a radially outwardly directed actuating surface and a downwardly directed load shoulder located above the actuating surface;

a trigger sleeve positioned at least partially below the body portion, the trigger sleeve being slidably supported relative to the body portion; and a load ring radially moveably supported on the trigger sleeve, the load ring being configured to engage the actuating surface and the load shoulder;

wherein the body portion is movable relative to the trigger sleeve from a first position in which the actuating surface is located above the load ring to a second position in which at least a part of the actuating surface is located radially adjacent the load ring;

wherein the actuating surface is configured such that, when the body portion is moved axially downwardly relative to the trigger sleeve from its first position to its second position, the actuating surface will force the load ring radially outwardly into engagement with the groove; and wherein in the second position of the body portion, the load shoulder engages the load ring such that the weight of the tubing hanger is transmitted from the tubing hanger landing shoulder through the load shoulder and the load ring to the tubing head.

12. The tubing head assembly of claim 11, wherein the trigger sleeve comprises a downwardly directed trigger shoulder configured to engage a trigger component located in the wellhead to thereby maintain the load ring in a fixed axial position relative to the tubing head.

13. The tubing head assembly of claim 12, wherein the adapter sleeve comprises an energizing mandrel which is movable to force the first sealing element into engagement with the first sealing profile or with both the first and second sealing profiles, and wherein the first locking element is supported on the energizing mandrel.

14. The tubing head assembly of claim 13, wherein the energizing mandrel comprises an upper mandrel part which is axially movably connected to a lower mandrel part, wherein the first locking element is supported on the upper mandrel part, and wherein the upper mandrel part is axially movable relative to the lower mandrel part to thereby adjust an axial distance between the first locking profile and the load shoulder on the adapter sleeve.

15. The tubing head assembly of claim 11, wherein the second locking profile is located on the energizing mandrel.

* * * * *